US010403146B2

(12) United States Patent
Ikedo et al.

(10) Patent No.: US 10,403,146 B2
(45) Date of Patent: Sep. 3, 2019

(54) DRIVING ASSISTANCE APPARATUS

(71) Applicant: TOYOTA JIDOSHA KABUSHIKI KAISHA, Toyota-shi, Aichi-ken (JP)

(72) Inventors: Yuji Ikedo, Sunto-gun (JP); Tomonori Akiyama, Susono (JP); Ryo Morishita, Mishima (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 15/833,966

(22) Filed: Dec. 6, 2017

(65) Prior Publication Data

US 2018/0174464 A1 Jun. 21, 2018

(30) Foreign Application Priority Data

Dec. 15, 2016 (JP) ..... 2016-243067

(51) Int. Cl.
*G08G 1/16* (2006.01)

(52) U.S. Cl.
CPC ..... *G08G 1/166* (2013.01)

(58) Field of Classification Search
CPC ..... G08G 1/166
See application file for complete search history.

(56) References Cited

U.S. PATENT DOCUMENTS

2007/0219720 A1* 9/2007 Trepagnier ..... B60W 30/00 701/300
2013/0124041 A1* 5/2013 Belser ..... B60W 30/095 701/41
2014/0028451 A1 1/2014 Takahashi et al.
2016/0140847 A1 5/2016 Kawamata et al.
2017/0008454 A1* 1/2017 Christensen ..... G08G 1/163
2017/0039855 A1* 2/2017 Maeda ..... B60K 31/0008

FOREIGN PATENT DOCUMENTS

JP 2013-156688 A 8/2013
JP 5435172 B2 3/2014
JP 2014-098965 A 5/2014
JP 2016-095697 A 5/2016

* cited by examiner

*Primary Examiner* — Rodney A Butler
(74) *Attorney, Agent, or Firm* — Oliff PLC

(57) ABSTRACT

A driving assistance apparatus includes a plurality of sensor devices mounted in a host vehicle, an attention calling device configured to call attention of a driver of the host vehicle, and at least one electronic control unit. The at least one electronic control unit acquires host vehicle information, acquires object information, estimates an expected path through which the host vehicle passes, determines whether or not a target object is present, determines whether or not there is a front space in front of the host vehicle based on the object information, generates a request signal so as to call attention of the driver of the host vehicle, forbids generation of the request signal when the electronic control unit determines that the target object is present, and that there is no front space, and controls the attention calling device to call attention of the driver.

3 Claims, 10 Drawing Sheets

DRIVING ASSISTANCE APPARATUS

INCORPORATION BY REFERENCE

The disclosure of Japanese Patent Application No. 2016-243067 filed on Dec. 15, 2016 including the specification, drawings and abstract is incorporated herein by reference in its entirety.

BACKGROUND

1. Technical Field

The present disclosure relates to a driving assistance apparatus that has a function of calling attention of a driver of a vehicle when an object is likely to cross a path through which the vehicle is expected to pass (hereinafter, simply referred to as an "expected path").

2. Description of Related Art

A driving assistance apparatus that is mounted in a vehicle and calls attention of a driver of the vehicle when an object is likely to cross an expected path of the vehicle is known in the related art (hereinafter, the vehicle in which the driving assistance apparatus is mounted will be referred to as a "host vehicle").

When a traveling direction of the host vehicle intersects with a traveling direction of the object at an intersection, an apparatus disclosed in, for example, Japanese Unexamined Patent Application Publication No. 2013-156688 (JP 2013-156688 A) (hereinafter, referred to as an "apparatus in the related art") predicts a first time period in which the host vehicle reaches the intersection, and a second time period in which the object reaches the intersection. Specifically, the apparatus in the related art predicts the first time period based on the position, the traveling direction, and the speed of the host vehicle at the current point in time, and predicts the second time period based on the position, the traveling direction, and the speed of the object at the current point in time.

The apparatus in the related art has a map that is set in advance. The map has a vertical axis denoting the first time period and a horizontal axis denoting the second time period. In the map, a region in which the absolute value of the difference in time between the first time period and the second time period is less than or equal to a predetermined value is set as an area in which the object is likely to cross the expected path of the host vehicle (that is, an area in which attention is called). The other region of the map is set as an area in which the object does not cross the expected path of the host vehicle (that is, an area in which attention is not called). The apparatus in the related art maps coordinates having components of the predicted first time period and second time period on the map, determines whether or not the object is likely to cross the expected path of the host vehicle by specifying the area in which the coordinates are positioned, and calls attention when the object is likely to cross the expected path of the host vehicle.

SUMMARY

The configuration of the apparatus in the related art may call attention of the driver to the object even when the object is actually very unlikely to cross the expected path of the host vehicle. That is, for example, even when the traveling direction of the host vehicle intersects with the traveling direction of the object at the intersection and when a determination that attention has to be called to the object is made from the predicted first time period and second time period, the object may not pass in front of the host vehicle when another vehicle travels in front of the host vehicle and when there is no space allowing the object to pass in front of the host vehicle due to the presence of the other vehicle. Consequently, the object is very unlikely to cross the expected path of the host vehicle. The apparatus in the related art does not consider whether or not there is a space in front of the host vehicle. Thus, the apparatus in the related art calls attention at all times when the apparatus in the related art determines, from the predicted first time period and second time period, that attention has to be called. Consequently, the apparatus in the related art may call attention to an object to which attention does not have to be called, and thus may give a feeling of inconvenience to the driver.

The present disclosure provides a driving assistance apparatus that can more appropriately call attention of a driver of a host vehicle.

An aspect of the present disclosure relates to a driving assistance apparatus including a plurality of sensor devices mounted in a host vehicle, an attention calling device configured to call attention of a driver of the host vehicle, and at least one electronic control unit. The at least one electronic control unit is configured to acquire, based on detection outputs of the sensor devices, host vehicle information including parameters related to a vehicle speed of the host vehicle and a yaw rate of the host vehicle, acquire, based on the detection outputs of the sensor devices, object information including a relative position of an object present around the host vehicle with respect to the host vehicle, a traveling direction of the object, and a speed of the object, estimate, based on the host vehicle information, an expected path through which the host vehicle is expected to pass, determine, based on the object information, whether or not a target object that is an object likely to cross the expected path within a threshold time period is present, determine, based on at least the object information, whether or not there is a front space that is a space allowing the target object to pass in front of the host vehicle, in front of the host vehicle, generate a request signal so as to call attention of the driver of the host vehicle, when the electronic control unit determines that the target object is present, and that there is the front space, forbid generation of the request signal when the electronic control unit determines that the target object is present, and that there is no front space, and control the attention calling device to call attention of the driver in response to generation of the request signal.

According to the aspect of the present disclosure, the electronic control unit determines whether or not the target object that is the object likely to cross the expected path of the host vehicle within the threshold time period is present. When the electronic control unit determines that the target object is present, the electronic control unit calls attention of the driver of the host vehicle. Even when, for example, the electronic control unit determines that the target object is present (that is, even when the electronic control unit calls attention), the target object may not pass in front of the host vehicle when there is no space allowing the target object to pass in front of the host vehicle, in front of the host vehicle. Consequently, the target object is actually very unlikely to cross the expected path of the host vehicle within the threshold time period. Calling attention in such a case is redundant and may give the driver a feeling of inconvenience. Thus, even when the electronic control unit determines that the target object is present, it is preferable not to call attention when the target object is actually very unlikely to cross the expected path of the host vehicle within the threshold time period due to the absence of the front space.

Therefore, according to the aspect of the present disclosure, the electronic control unit is configured to determine, based on at least the object information, whether or not there is the front space that is the space allowing the target object to pass in front of the host vehicle, in front of the host vehicle, and the electronic control unit is configured to forbid generation of the request signal when the electronic control unit determines that the target object is present, and that there is no front space.

According to the aspect of the present disclosure, the electronic control unit determines, based on at least the object information, whether or not there is the front space that is the space allowing the target object to pass in front of the host vehicle, in front of the host vehicle. When the electronic control unit determines that there is no front space, the electronic control unit forbids attention calling even when the electronic control unit determines that the target object is present. When there is no front space, the target object may not pass in front of the host vehicle. Thus, the target object is very unlikely to cross the expected path of the host vehicle within the threshold time period. Accordingly, even when the electronic control unit determines that the target object is present, the aspect of the present disclosure can forbid attention calling when the target object is actually very unlikely to cross the expected path of the host vehicle within the threshold time period due to the absence of the front space. Thus, the aspect of the present disclosure can significantly reduce the possibility of attention calling that does not have to be performed, and can more appropriately call attention of the driver of the host vehicle.

In the driving assistance apparatus according to the aspect of the present disclosure, the electronic control unit may be configured to extract an object that is present around the host vehicle. The electronic control unit may determine whether or not all of a predetermined front and rear distance condition, a predetermined horizontal distance condition, and a predetermined horizontal speed condition are satisfied. The front and rear distance condition may be a condition that a front and rear distance that is a distance from the host vehicle to the extracted object in a traveling direction of the host vehicle is less than or equal to a predetermined front and rear distance threshold. The horizontal distance condition may be a condition that a horizontal distance is less than or equal to a predetermined horizontal distance threshold. The horizontal distance may be a distance from the host vehicle to the extracted object in an orthogonal direction that is a direction orthogonal with respect to the traveling direction of the host vehicle. The horizontal speed condition may be a condition that a horizontal speed that is a speed of the extracted object in the orthogonal direction is less than or equal to a predetermined horizontal speed threshold. The electronic control unit may be configured to determine that there is no front space, when the electronic control unit determines that the extracted object satisfies all of the conditions.

The aspect of the present disclosure can consider the traveling direction of the object satisfying the horizontal speed condition as being approximately parallel to the traveling direction of the host vehicle, by setting the horizontal speed threshold to an appropriate value. Thus, in the configuration described above, the electronic control unit determines whether or not the object of which the traveling direction is approximately parallel to the traveling direction of the host vehicle is present within a "region that has a length of the front and rear distance threshold from the host vehicle in the traveling direction of the host vehicle and has a length of the horizontal distance threshold from the host vehicle on each of both sides of the host vehicle in the orthogonal direction of the host vehicle (hereinafter, referred to as a "front region")". When the electronic control unit determines that the object is present, the electronic control unit determines that there is no front space. Accordingly, by setting each of the front and rear distance threshold and the horizontal distance threshold to an appropriate value, when the object of which the traveling direction is approximately parallel to the host vehicle is present within the front region, the object hinders traveling of the target object. Consequently, the target object is very unlikely to cross the expected path of the host vehicle within the threshold time period. The configuration described above can determine that there is no front space, when the target object is very unlikely to cross the expected path of the host vehicle within the threshold time period. Thus, the configuration can appropriately determine whether or not there is the front space.

In the driving assistance apparatus according to the aspect of the present disclosure, the electronic control unit may be configured to determine whether or not the host vehicle is traveling straight. When the electronic control unit determines that the host vehicle is traveling straight, the electronic control unit may estimate, as the expected path, a path that extends in a linear shape in the traveling direction of the host vehicle from the host vehicle and has a predetermined length. The electronic control unit may be configured to set the front and rear distance threshold to be less than or equal to the predetermined length of the expected path of the host vehicle.

According to the aspect of the present disclosure, the front and rear distance threshold is less than or equal to the length of the expected path of the host vehicle. Thus, the front region is present on the expected path through which the target object is expected to pass. Accordingly, when the object of which the traveling direction is approximately parallel to the traveling direction of the host vehicle is present within the front region, the object hinders traveling of the target object. Consequently, the target object is very unlikely to cross the expected path of the host vehicle within the threshold time period. The configuration described above can determine that there is no front space, when the target object is very unlikely to cross the expected path of the host vehicle within the threshold time period. Thus, the configuration can more appropriately determine whether or not there is the front space.

BRIEF DESCRIPTION OF THE DRAWINGS

Features, advantages, and technical and industrial significance of exemplary embodiments of the present disclosure will be described below with reference to the accompanying drawings, in which like numerals denote like elements, and wherein.

DETAILED DESCRIPTION OF EMBODIMENTS

Embodiment

Figure 1:
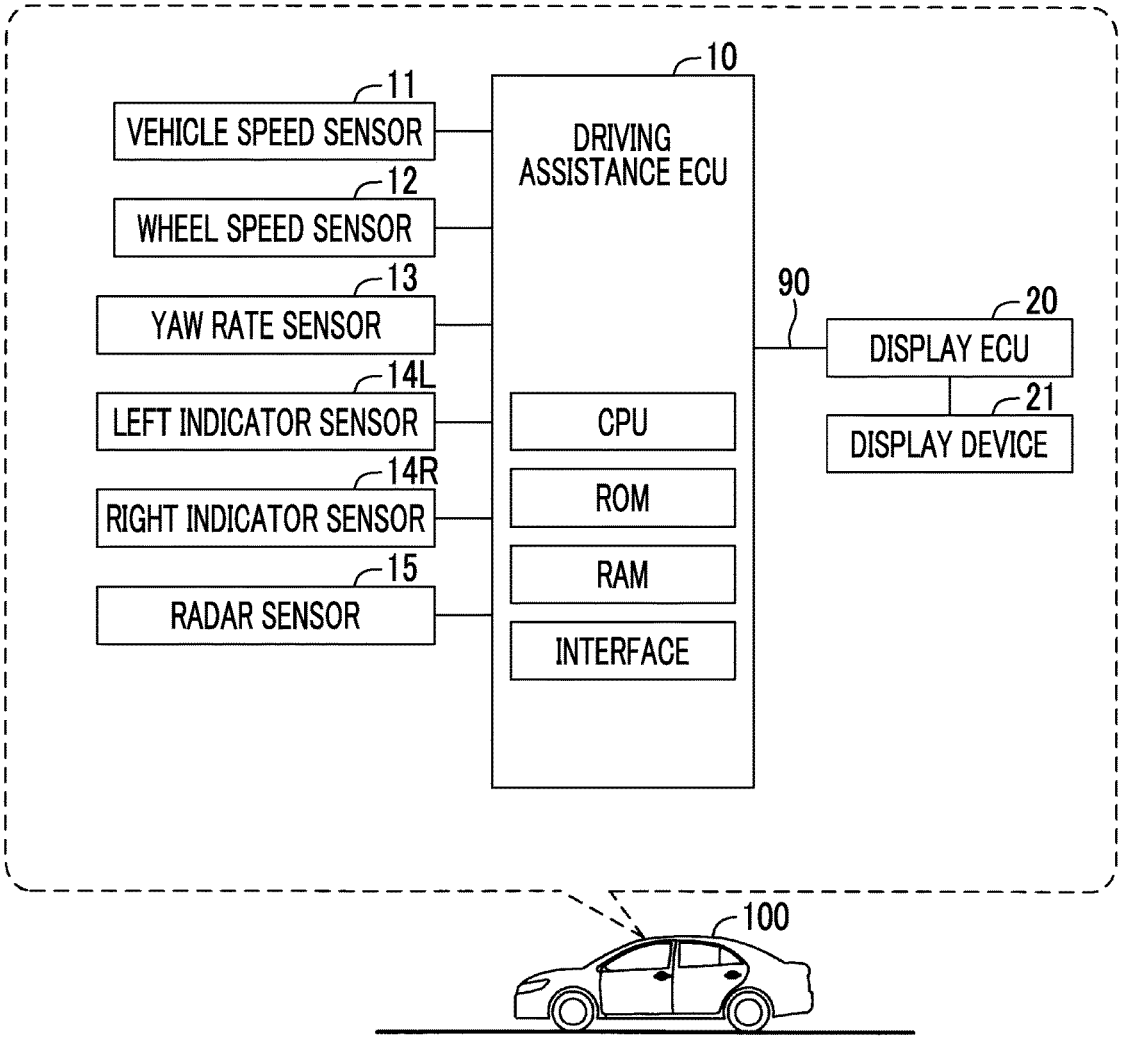
FIG. 1 is a diagram illustrating a driving assistance apparatus according to an embodiment of the present disclosure (hereinafter, referred to as the "present embodied apparatus") and a vehicle to which the driving assistance apparatus is applied.

Hereinafter, a driving assistance apparatus according to an embodiment (hereinafter, referred to as the "present embodied apparatus") will be described with reference to the drawings. The present embodied apparatus is applied to a host vehicle 100 illustrated in FIG. 1. The host vehicle 100 is an automobile that has an engine, not illustrated, as a power source. The present embodied apparatus includes a driving assistance ECU (one example of an electronic control unit) 10 and a display ECU 20.

ECU is the abbreviation for electronic control unit. Each of the driving assistance ECU 10 and the display ECU 20 is an electronic control circuit that has a main component of a microcomputer including a CPU, a ROM, a RAM, an interface, and the like. The CPU realizes various functions described below by executing instructions (routines) stored in a memory (ROM). The driving assistance ECU 10 and the display ECU 20 may be combined into one ECU.

The driving assistance ECU 10 and the display ECU 20 are connected to each other through a communication and sensor system controller area network (CAN) 90 in a manner capable of exchanging data (communicably).

The host vehicle 100 includes a vehicle speed sensor 11, a wheel speed sensor 12, a yaw rate sensor 13, a left indicator sensor 14L, a right indicator sensor 14R, a radar sensor 15, and a display device 21. The sensors 11 to 15 are connected to the driving assistance ECU 10, and the display device 21 is connected to the display ECU 20. While the host vehicle 100 includes a plurality of sensors detecting a driving state of the host vehicle 100 in addition to the sensors 11 to 15, the present embodiment will describe sensors related to the configuration of the driving assistance apparatus disclosed in the present specification.

The vehicle speed sensor 11 detects a speed (vehicle speed) SPDv [km/h] of the host vehicle 100 and outputs a signal indicating the vehicle speed SPDv to the driving assistance ECU 10. The driving assistance ECU 10 acquires the vehicle speed SPDv based on the signal received from the vehicle speed sensor 11 each time a predetermined calculation time period Tcal [s] elapses.

The wheel speed sensor 12 is disposed at each of right and left front wheels (not illustrated) and right and left rear wheels (not illustrated) of the host vehicle 100. Each wheel speed sensor 12 detects a rotational speed WS [rps] of each wheel and outputs a signal indicating the rotational speed WS to the driving assistance ECU 10. The driving assistance ECU 10 acquires the rotational speed WS of each wheel based on the signal received from each wheel speed sensor 12 each time the predetermined calculation time period Tcal elapses. The driving assistance ECU 10 can acquire the vehicle speed SPDv [m/s] based on the rotational speed WS.

The yaw rate sensor 13 detects an angular velocity (yaw rate) Y [°/sec] of the host vehicle 100 and outputs a signal indicating the yaw rate Y to the driving assistance ECU 10. The driving assistance ECU 10 acquires the yaw rate Y based on the signal received from the yaw rate sensor 13 each time the calculation time period Tcal elapses.

When a left indicator is changed from a turned-off state to a blinking state, the left indicator sensor 14L outputs a signal indicating the blinking state of the left indicator to the driving assistance ECU 10. The driving assistance ECU 10 acquires the state of the left indicator based on the signal received from the left indicator sensor 14L each time the calculation time period Tcal elapses.

When a right indicator is changed from a turned-off state to a blinking state, the right indicator sensor 14R outputs a signal indicating the blinking state of the right indicator to the driving assistance ECU 10. The driving assistance ECU 10 acquires the state of the right indicator based on the signal received from the right indicator sensor 14R each time the calculation time period Tcal elapses.

The radar sensor 15 is disposed at each of the left end, the center, and the right end of a front end portion of the host vehicle 100. Each radar sensor 15 transmits an electromagnetic wave in a forward left diagonal direction, a forward front direction, and a forward right diagonal direction of the host vehicle 100. When a body such as another vehicle or a pedestrian is present within the range of reach of the electromagnetic wave (hereinafter, referred to as a "transmitted wave"), the transmitted wave is reflected by the body. Each radar sensor 15 receives the reflected transmitted wave (hereinafter, referred to as a "reflected wave"). Each radar sensor 15 outputs a signal indicating the transmitted wave and a signal indicating the reflected wave to the driving assistance ECU 10. Hereinafter, a body that is present within the range of reach of the electromagnetic wave will be referred to as an "object".

The driving assistance ECU 10 determines whether or not an object that is likely to cross an expected path of the host vehicle 100 within a threshold time period is present (described below). When the driving assistance ECU 10 determines that an object is present, the driving assistance ECU 10 generates a request signal so as to call attention of a driver of the host vehicle 100 to the object and transmits the request signal to the display ECU 20.

The display device 21 is a display device that is disposed in a position visually recognizable from a driving seat of the host vehicle 100 (for example, in an instrument cluster panel). When the display ECU 20 receives the request signal from the driving assistance ECU 10, the display ECU 20 transmits an instruction signal to the display device 21. When the display device 21 receives the instruction signal from the display ECU 20, the display device 21 displays information so as to call attention of the driver. The display device 21 may be a head-up display, a center display, or the like.

Summary of Operation of Present Embodied Apparatus

Next, a summary of operation of the present embodied apparatus will be described. The present embodied apparatus performs two types of determination of a target object determination and a front space determination described below. The target object determination is a determination as to whether or not an object that is likely to cross the expected path of the host vehicle 100 within the threshold time period (hereinafter, referred to as a "target object") is present. The front space determination is a determination as to whether or not there is a front space that is a space allowing the target object to pass in front of the host vehicle 100, in front of the host vehicle 100. The present embodied apparatus determines whether or not to call attention based on the result of the two determinations. Hereinafter, the target object determination and the front space determination will be specifically described.

A. Common Operation in Target Object Determination and Front Space Determination First, common operation in the target object determination and the front space determination will be described. When an engine switch (ignition key switch), not illustrated, of the host vehicle 100 is switched into an ON state, the present embodied apparatus acquires, before the engine switch is switched into an OFF state, information of the host vehicle 100 (host vehicle information) each time the calculation time period Tcal elapses, and sets coordinate axes based on the host vehicle information with the current position of the host vehicle 100 as an origin. The present embodied apparatus determines whether or not an object is present around the host vehicle 100. When the present embodied apparatus determines that an object is present, the present embodied apparatus acquires object information of the object. Hereinafter, the common operation will be more specifically described. Hereinafter, a period in which the engine switch is switched from the ON state to the OFF state will be referred to as an "engine ON period". For any element e, the element e at an n-th calculation cycle will be denoted by e(n), and a point in time when the engine switch is switched into the ON state will be defined as n=0. The host vehicle 100 may be, for example, a hybrid vehicle or an electric automobile. In such a case, for a start switch (for example, a ready switch) that sets the host vehicle 100 into a state capable of traveling, switching the start switch into the ON state has the same meaning as switching the engine switch into the ON state. Switching the start switch into the OFF state has the same meaning as switching the engine switch into the OFF state.

Acquisition of Host Vehicle Information and Setting of Coordinate Axes

Figure 2:
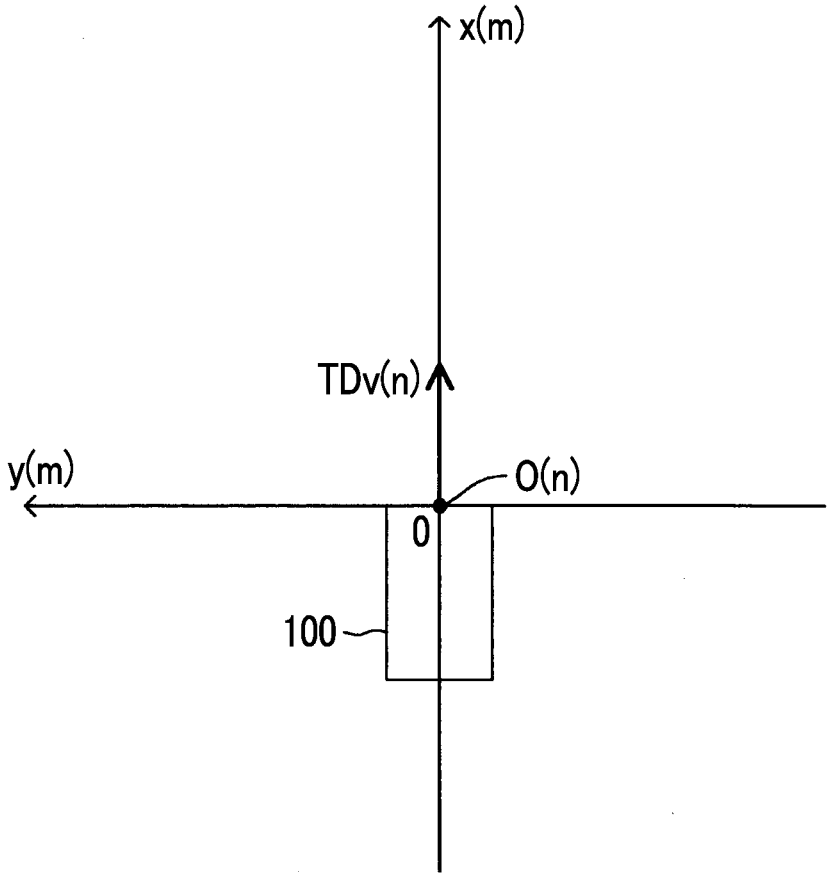
FIG. 2 is a diagram illustrating coordinate axes that are set by the present embodied apparatus around the host vehicle at an n-th cycle.

The driving assistance ECU 10 of the present embodied apparatus acquires the vehicle speed SPDv(n), the wheel speed SW(n), the yaw rate Y(n), and the states of the right and left indicators as the host vehicle information based on the signals received from the sensor 11, the sensor 12, the sensor 13, the sensor 14L, and the sensor 14R and stores the host vehicle information in the RAM of the driving assistance ECU 10. The driving assistance ECU 10 sets coordinate axes based on the host vehicle information with the current position of the host vehicle 100 as an origin. Specifically, as illustrated in FIG. 2, the driving assistance ECU 10 sets the center of the front end portion of the host vehicle 100 at the n-th cycle as an origin O(n) (0,0) at the n-th cycle, sets an x axis in a traveling direction TDv(n) of the host vehicle 100 at the n-th cycle, and sets a y axis in a direction that passes through the origin O(n) and is orthogonal with respect to the traveling direction TDv(n) of the host vehicle 100. The x axis has the traveling direction TDv(n) as a positive direction, and the y axis has the left direction of the host vehicle 100 as a positive direction. The driving assistance ECU 10 determines the traveling direction TDv(n) from the vehicle speed SPDv(n) (or the wheel speed SW(n)) and the yaw rate Y(n) at the n-th cycle. The driving assistance ECU 10 stores information indicating the coordinate axes in the RAM of the driving assistance ECU 10. The units of an x component and a y component in the xy coordinate plane are [m].

Acquisition of Object Information

Figure 3:
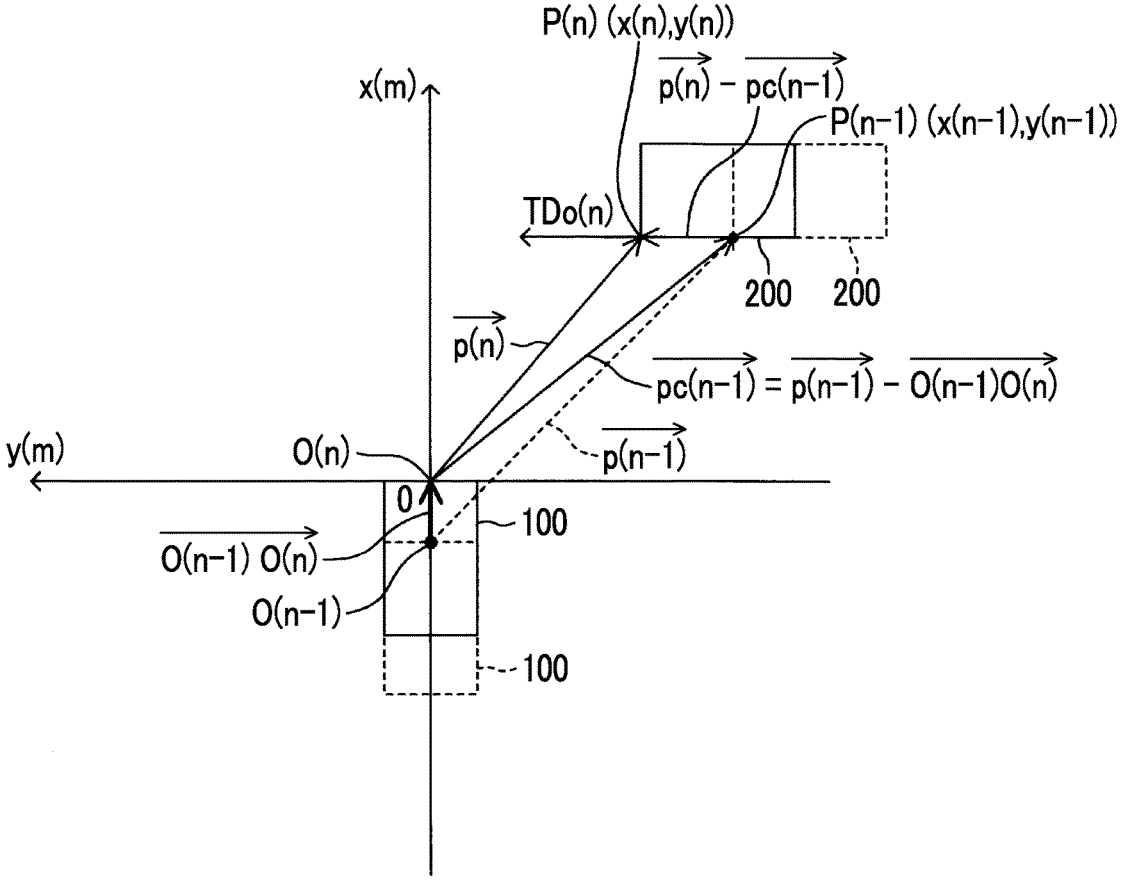
FIG. 3 is a diagram that illustrates a positional relationship between the host vehicle and an object at an (n−1)-th cycle and the n-th cycle and is used for describing acquisition of object information of the object at the n-th cycle.

The driving assistance ECU 10 determines whether or not an object is present around the host vehicle 100 based on the signals received from each radar sensor 15. When the driving assistance ECU 10 determines that an object is present, the driving assistance ECU 10 acquires the distance from the host vehicle 100 to the object and the azimuth of the object with respect to the host vehicle 100. The driving assistance ECU 10 calculates coordinates (x(n),y(n)) of a relative position P(n) of the object at the n-th cycle with respect to the position of the host vehicle 100 at the n-th cycle (that is, the origin O(n)) from the distance and the azimuth of the object at the n-th cycle. In addition, as illustrated in FIG. 3, the driving assistance ECU 10 calculates a traveling direction TDo(n) and a speed SPDo(n) [km/h] of an object 200 at the n-th cycle by a procedure below. The object 200 is one example of the object. In FIG. 3, the host vehicle 100 and the object 200 at the n-th cycle are illustrated by a solid line, and the host vehicle 100 and the object 200 at the (n−1)-th cycle are illustrated by a broken line.

Calculation of Traveling Direction TDo of Object

First, the driving assistance ECU 10 calculates a position vector p(n) of the relative position P(n) of the object 200 at the n-th cycle and the position vector p(n−1) of the relative position P(n−1) of the object 200 at the (n−1)-th cycle by General Formula (1) and General Formula (2).

$$p(n)=(x(n),y(n)) \tag{1}$$

$$p(n-1)=(x(n-1),y(n-1)) \tag{2}$$

As is apparent from General Formula (1) and General Formula (2), the components of the position vector p(n) are equal to the coordinates of the relative position P(n) of the object 200 at the n-th cycle, and the components of the position vector p(n−1) are equal to the coordinates of the relative position P(n−1) of the object 200 at the (n−1)-th cycle. That is, the position vector p(n) is a vector having the origin O(n) at the n-th cycle as a starting point, and the position vector p(n−1) is a vector having the origin O(n−1) at the (n−1)-th cycle as a starting point. Thus, both vectors have different starting points. Accordingly, the driving assistance ECU 10 transforms the position vector p(n−1) to a position vector pc(n−1) having the origin O(n) at the n-th cycle as a starting point by General Formula (3).

$$pc(n-1)=p(n-1)-O(n-1)O(n) \tag{3}$$

The vector O(n−1)O(n) is a vector from the origin O(n−1) at the (n−1)-th cycle to the origin O(n) at the n-th cycle. The vector O(n−1)O(n) is a vector that has a magnitude of a value acquired by multiplying the vehicle speed SPDv(n−1) of the host vehicle 100 at the (n−1)-th cycle by the calculation time period Tcal and has a direction of the traveling direction TDv(n−1) at the (n−1)-th cycle.

The driving assistance ECU 10 calculates a displacement direction of the object 200 from the (n−1)-th cycle to the n-th cycle by subtracting General Formula (3) from General Formula (1) by General Formula (4).

$$p(n)-pc(n-1)=p(n)-p(n-1)+O(n-1)O(n) \quad (4)$$

The driving assistance ECU 10 calculates the displacement direction of the object represented by General Formula (4) as the traveling direction TDo(n) of the object 200 at the n-th cycle.

Calculation of Speed SPDo of Object

Next, the driving assistance ECU 10 calculates the speed SPDo(n) of the object 200 at the n-th cycle by General Formula (5). The magnitude of a vector X is denoted by abs{X}.

$$SPDo(n)=\mathrm{abs}\{p(n)-p(n-1)+O(n-1)O(n)\}/T\mathrm{cal} \quad (5)$$

That is, the driving assistance ECU 10 calculates, as the speed SPDo(n) of the object 200 at the n-th cycle, a value acquired by dividing the amount of displacement (abs{p(n)−p(n−1)+O(n−1)O(n)}) of the object 200 from the (n−1)-th cycle to the n-th cycle by the calculation time period Tcal. The driving assistance ECU 10 stores the coordinates of the relative position P(n) of the object, the traveling direction TDo(n) of the object, and the speed SPDo(n) of the object in the RAM of the driving assistance ECU 10 as the object information. When each radar sensor 15 outputs signals reflected by the same object to the driving assistance ECU 10, the driving assistance ECU 10 acquires the object information as to the same object based on the signals.

B. Operation Related to Target Object Determination

Next, operation related to the target object determination will be described. In the engine ON period, each time the calculation time period Tcal elapses, the driving assistance ECU 10 determines whether the host vehicle 100 makes a left turn or a right turn or travels straight, and estimates the expected path of the host vehicle 100 in accordance with the determination result. The expected path is estimated as a path having an arc shape when the host vehicle 100 makes a right or left turn (includes when the host vehicle 100 temporarily stops while making the right or left turn), and is estimated as a path having a line segment shape when the host vehicle 100 travels straight (includes when the host vehicle 100 temporarily stops while traveling straight). The driving assistance ECU 10 estimates the expected path of the object and determines whether or not an object that intersects with the expected path of the host vehicle 100 within the threshold time period is present. When the driving assistance ECU 10 determines that the object is present, the driving assistance ECU 10 determines that attention has to be called to the object, and sets the value of an attention calling flag to 1 for the object. When the driving assistance ECU 10 determines that the object is not present, the driving assistance ECU 10 determines that attention does not have to be called to the object, and sets the value of the attention calling flag to 0 for the object. Hereinafter, a method of the target object determination will be more specifically described.

Left Turn Start Condition and Right Turn Start Condition

When the driving assistance ECU 10 determines whether the host vehicle 100 makes a left turn or a right turn or travels straight, the driving assistance ECU 10 first determines whether or not the host vehicle 100 starts to make a left turn or a right turn. The driving assistance ECU 10 determines that the host vehicle 100 starts to make a left turn, when a left turn start condition described below is established. The driving assistance ECU 10 determines that the host vehicle 100 starts to make a right turn, when a right turn start condition described below is established.

Left Turn Start Condition

The left turn start condition is established when any one of conditions L1, L2, L3 below is established.

(Condition L1) The left indicator is changed from the turned-off state to the blinking state when the vehicle speed SPDv(n) is greater than or equal to a first vehicle speed threshold SPDv1th (0 km/h in the present example) and less than or equal to a second vehicle speed threshold SPDv2th (20 km/h in the present example). The first vehicle speed threshold SPDv1th and the second vehicle speed threshold SPDv2th are set in advance respectively as a lower limit value and an upper limit value of a general speed range when the host vehicle 100 starts to make a left turn. The same applies to the right turn.

(Condition L2) When the left indicator is in the blinking state, the vehicle speed SPDv(n) is changed to a speed greater than or equal to the first vehicle speed threshold SPDv1th and less than or equal to the second vehicle speed threshold SPDv2th.

(Condition L3) The left indicator is changed from the turned-off state to the blinking state at the same time as when the vehicle speed SPDv(n) is changed to a speed greater than or equal to the first vehicle speed threshold SPDylth and less than or equal to the second vehicle speed threshold SPDv2th.

Right Turn Start Condition

The right turn start condition is established when any one of conditions R1, R2, R3 below is established.

(Condition R1) The right indicator is changed from the turned-off state to the blinking state when the vehicle speed SPDv(n) is greater than or equal to the first vehicle speed threshold SPDv1th and less than or equal to the second vehicle speed threshold SPDv2th.

(Condition R2) When the right indicator is in the blinking state, the vehicle speed SPDv(n) is changed to a speed greater than or equal to the first vehicle speed threshold SPDv1th and less than or equal to the second vehicle speed threshold SPDv2th.

(Condition R3) The right indicator is changed from the turned-off state to the blinking state at the same time as when the vehicle speed SPDv(n) is changed to a speed greater than or equal to the first vehicle speed threshold SPDv1th and less than or equal to the second vehicle speed threshold SPDv2th.

Left Turn Condition and Right Turn Condition

Generally, while the host vehicle 100 is making a left turn or a right turn (that is, while the host vehicle 100 starts to make a left turn or a right turn, actually makes a left turn or a right turn, and then finishes the left turn or the right turn), the vehicle speed SPDv(n) of the host vehicle 100 satisfies SPDv1th SPDv(n) SPDv2th, and the left indicator or the right indicator remains in the blinking state. Accordingly, once the left turn start condition or the right turn start condition is established, Conditions L1 to L3 or Conditions R1 to R3 are not established before the host vehicle 100 finishes the left turn or the right turn. Thus, the left turn start condition or the right turn start condition is not established again. Accordingly, after the driving assistance ECU 10 determines that the left turn start condition or the right turn start condition is established, the driving assistance ECU 10 determines that the host vehicle 100 is making a left turn or a right turn, before the driving assistance ECU 10 determines that the left indicator or the right indicator is not in the blinking state (that is, changed to the turned-off state), or before the driving assistance ECU 10 determines that a "turning angle θtotal(n) (described below) of the host vehicle 100 from the start of a left turn or a right turn to the current point in time" exceeds a "general turning angle (90° in the present example) at the time of making a left turn or a right turn".

Initialization of Turning Angle θtotal and Calculation of Turning Angle θ(n)

After the driving assistance ECU 10 determines that the left turn start condition or the right turn start condition is established, the driving assistance ECU 10 calculates the turning angle θtotal(n) of the host vehicle 100 while the driving assistance ECU 10 determines that the host vehicle 100 is making a left turn or a right turn. Specifically, when the driving assistance ECU 10 determines that the left turn start condition or the right turn start condition is established at an m-th cycle, the driving assistance ECU 10 calculates the turning angle θtotal(n) of the host vehicle 100 from the m-th cycle to the n-th cycle by General Formula (6) and General Formula (7).

$$\text{When } n=m,\ \theta\text{total}(m)=0° \tag{6}$$

$$\text{When } n\geq m+1,\ \theta\text{total}(n)=\theta\text{total}(n-1)+\theta(n) \tag{7}$$

That is, the present embodied apparatus sets (initializes) the turning angle θtotal(m) to 0° at a cycle (n=m) when the driving assistance ECU 10 determines that the left turn start condition or the right turn start condition is established. Otherwise (n≥m+1), the driving assistance ECU 10 calculates the turning angle θtotal(n) by adding an instantaneous turning angle θ(n) to the immediately previous turning angle θtotal(n−1). The instantaneous turning angle θ(n) is calculated by multiplying the yaw rate Y(n) at the n-th cycle and the calculation time period Tcal. The average value of the yaw rates Y acquired at a plurality of immediately previous cycles including Y(n) (hereinafter, the average value will be referred to as a "smooth yaw rate Ys(n)") may be used as the yaw rate Y(n). The driving assistance ECU 10 stores the turning angle θtotal(n) in the RAM of the driving assistance ECU 10.

Straight Traveling Condition

The driving assistance ECU 10 determines that the host vehicle 100 is traveling straight, when the driving assistance ECU 10 determines that the left indicator and the right indicator are in the turned-off state with the left turn start condition and the right turn start condition not established once after the driving assistance ECU 10 determines that the previous left turn or the previous right turn is finished. The driving assistance ECU 10 stores the determination result (that is, whether the host vehicle 100 is making a left turn or a right turn or is traveling straight) in the RAM of the driving assistance ECU 10.

Estimation of Left-Side Expected Path and Right-Side Expected Path of Host Vehicle 100

When the driving assistance ECU 10 determines that the host vehicle 100 is making a left turn or a right turn, and when the driving assistance ECU 10 determines that the host vehicle 100 is traveling straight, the driving assistance ECU 10 estimates an expected path through which a left end OL(n) (refer to FIG. 4A and FIG. 4B) of the front end portion of the host vehicle 100 is expected to pass (left-side expected path), and an expected path through which a right end OR(n) (refer to FIG. 4A and FIG. 4B) of the front end portion of the host vehicle 100 is expected to pass (right-side expected path). When the driving assistance ECU 10 determines that the host vehicle 100 is making a left turn or a right turn, the driving assistance ECU 10 estimates the left-side expected path and the right-side expected path as paths having an arc shape. When the driving assistance ECU 10 determines that the host vehicle 100 is traveling straight, the driving assistance ECU 10 estimates the left-side expected path and the right-side expected path as paths having a linear shape and a finite length (that is, a line segment shape). Hereinafter, the left-side expected path and the right-side expected path having an arc shape will be respectively referred to as a "first left-side expected path" and a "first right-side expected path". The left-side expected path and the right-side expected path having a line segment shape will be respectively referred to as a "second left-side expected path" and a "second right-side expected path". Hereinafter, a method of estimating the first left-side expected path and the first right-side expected path will be described, and then, a method of estimating the second left-side expected path and the second right-side expected path will be described.

Figure 4A:
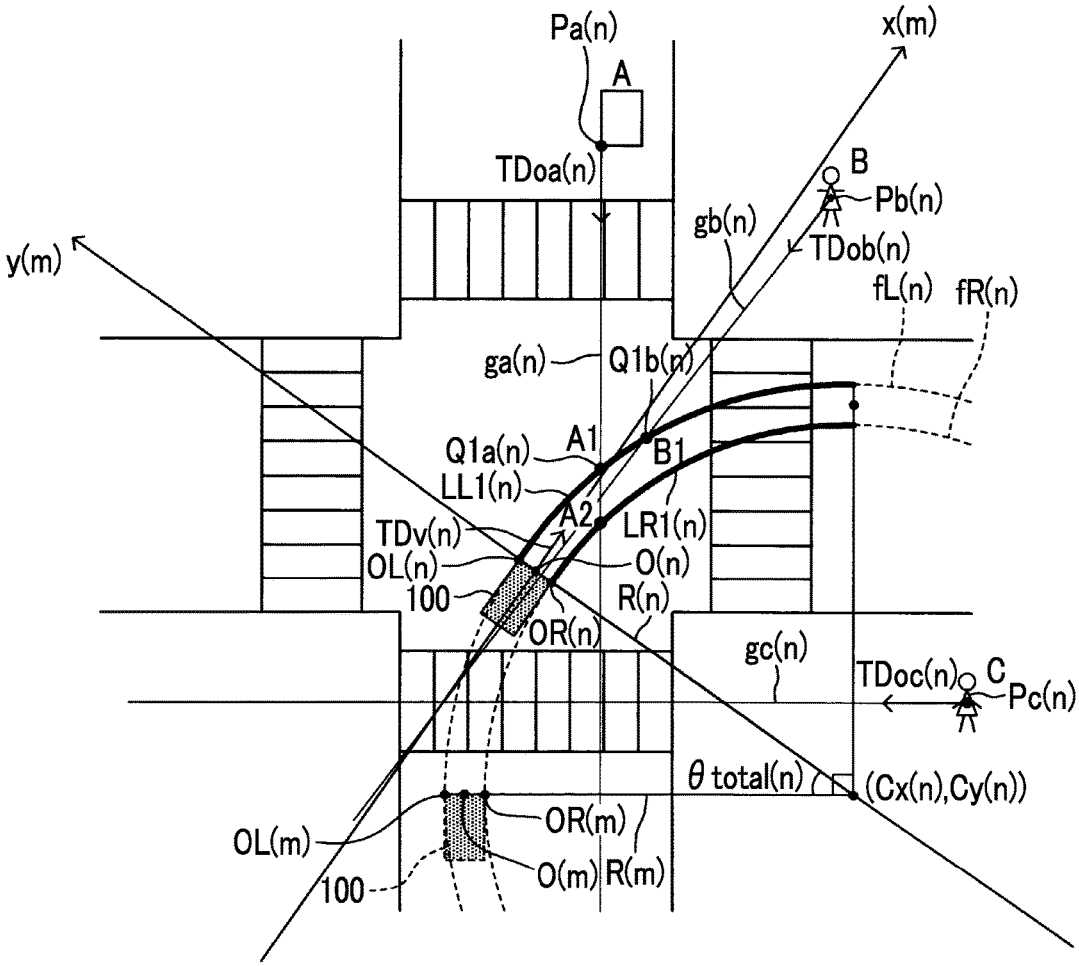
FIG. 4A is a diagram that illustrates an on-road positional relationship between the host vehicle and the object present around the host vehicle at the n-th cycle and is used for describing the presence or absence of a target object at the n-th cycle when the host vehicle makes a right turn.

1. Estimation of First Left-Side Expected Path and First Right-Side Expected Path: 1-1. Calculation of Turning Radius R As illustrated in FIG. 4A, when the driving assistance ECU 10 determines that the host vehicle 100 is making a left turn or a right turn, the driving assistance ECU 10 estimates the first left-side expected path (illustrated by a bold line in FIG. 4A) at the n-th cycle in the xy coordinate plane as a part of a first left-side expected path formula fL1(n) (described below) that is a formula of a circle, and estimates the first right-side expected path (illustrated by a bold line in FIG. 4A) at the n-th cycle as a part of a first right-side expected path formula fR1(n) (described below) that is a formula of a circle. The driving assistance ECU 10 calculates the center coordinates and the radiuses of the circles based on a turning radius R(n) that is the radius of a circle through which the origin O(n) of the host vehicle 100 is expected to pass. The turning radius R(n) is calculated by, for example, dividing the vehicle speed SPDv(n) by |Ys(n)| that is the magnitude of the smooth yaw rate Ys(n) (that is, R(n)=SPDv(n)/|Ys(n)|). A detailed method of acquiring R(n) is also disclosed in Japanese Patent Application No. 2016-224957 of the present applicant.

1-2. Calculation of First Left-Side Expected Path Formula fL1 and First Right-Side Expected Path Formula fR1

The driving assistance ECU 10 calculates center coordinates (Cx(n),Cy(n)) and a left-side turning radius RL(n) of the circle represented by the first left-side expected path formula fL1(n) by General Formula (8) to General Formula (11) below based on the turning radius R(n) calculated in 1-1. The driving assistance ECU 10 calculates the first left-side expected path formula fL1(n) represented by General Formula (12) by using the center coordinates (Cx(n), Cy(n)) and the left-side turning radius RL(n). Similarly, the driving assistance ECU 10 calculates the center coordinates (Cx(n),Cy(n)) and a right-side turning radius RR(n) of the circle represented by the first right-side expected path formula fR1(n) by General Formula (13) to General Formula (16) below based on the turning radius R(n) calculated in 1-1. The driving assistance ECU 10 calculates the first right-side expected path formula fR1(n) represented by General Formula (17) by using the center coordinates (Cx(n),Cy(n)) and the right-side turning radius RR(n). The width (the length in the y-axis direction) of the host vehicle 100 is denoted by w [m]. The width w is set in advance for each vehicle in which the driving assistance ECU 10 will be mounted.

Center coordinates (Cx(n),Cy(n)) of first left-side expected path formula fL1(n):

$$\text{(Left turn) } (Cx(n),Cy(n))=(0,R(n)) \quad (8)$$

$$\text{(Right turn) } (Cx(n),Cy(n))=(0,-R(n)) \quad (9)$$

Left-side turning radius RL(n) of first left-side expected path formula fL1(n):

$$\text{(Left turn) } RL(n)=R(n)-w/2 \quad (10)$$

$$\text{(Right turn) } RL(n)=R(n)+w/2 \quad (11)$$

First left-side expected path formula fL1(n):

$$(x(n)-Cx(n))^2+(y(n)-Cy(n))^2=RL(n)^2 \quad (12)$$

Center coordinates (Cx(n),Cy(n)) of first right-side expected path formula fR1(n):

$$\text{(Left turn) } (Cx(n),Cy(n))=(0,R(n)) \quad (13)$$

$$\text{(Right turn) } (Cx(n),Cy(n))=(0,-R(n)) \quad (14)$$

Right-side turning radius RR(n) of first right-side expected path formula fR1(n):

$$\text{(Left turn) } RR(n)=R(n)+w/2 \quad (15)$$

$$\text{(Right turn) } RR(n)=R(n)-w/2 \quad (16)$$

First right-side expected path formula fR1(n):

$$(x(n)-Cx(n))^2+(y(n)-Cy(n))^2=RR(n)^2 \quad (17)$$

That is, the driving assistance ECU 10 calculates the center coordinates (Cx(n),Cy(n)) of the first left-side expected path formula fL1(n) on the y axis (that is, a direction that passes through the origin O(n) and is orthogonal with respect to the traveling direction TDv(n) of the host vehicle 100) as a point moved by the magnitude of the turning radius R(n) in the positive direction of the y axis from the origin O(n) when the host vehicle 100 makes a left turn, and as a point moved by the magnitude of the turning radius R(n) in the negative direction of the y axis from the origin O(n) when the host vehicle 100 makes a right turn (refer to General Formula (8) and General Formula (9)). The driving assistance ECU 10 calculates the center coordinates (Cx(n),Cy(n)) of the first right-side expected path formula fR1(n) as the same point as the center coordinates (Cx(n), Cy(n)) of the first left-side expected path formula fL1(n) (refer to General Formula (8), General Formula (9), General Formula (13), and General Formula (14)).

The driving assistance ECU 10 calculates the left-side turning radius RL(n) of the first left-side expected path formula fL1(n) by subtracting a half length (half vehicle width) w/2 of the vehicle width w of the host vehicle 100 from the turning radius R(n) when the host vehicle 100 makes a left turn, and by adding the half vehicle width w/2 to the turning radius R(n) when the host vehicle 100 makes a right turn (refer to General Formula (10) and General Formula (11)). The driving assistance ECU 10 calculates the right-side turning radius RR(n) of the first right-side expected path formula fR1(n) by adding the half vehicle width w/2 to the turning radius R(n) when the host vehicle 100 makes a right turn, and by subtracting the half vehicle width w/2 from the turning radius R(n) when the host vehicle 100 makes a left turn (refer to General Formula (15) and General Formula (16)). The driving assistance ECU 10 stores the first expected path formulas fL1(n), fR1(n) in the RAM of the driving assistance ECU 10.

1-3. Calculation of Length LL1 of First Left-Side Expected Path and Length LR1 of First Right-Side Expected Path The driving assistance ECU 10 calculates a length LL1(n) of the first left-side expected path and a length LR1(n) of the first right-side expected path by General Formula (18) and General Formula (19).

$$LL1(n)=RL(n)\cdot(90°-\theta\text{total}(n))\sim\pi/180° \quad (18)$$

$$LR1(n)=RR(n)\cdot(90°-\theta\text{total}(n))\cdot\pi/180° \quad (19)$$

That is, the driving assistance ECU 10 calculates the length LL1(n) of the first left-side expected path and the length LR1(n) of the first right-side expected path as the length of an arc corresponding to a turning angle that the host vehicle 100 forms before finishing the left turn or the right turn in a location where the host vehicle 100 is making the left turn or the right turn at the current point in time (that is, 90°−θtotal(n)). The driving assistance ECU 10 stores the length LL1(n) and the length LR1(n) of each first expected path in the RAM of the driving assistance ECU 10.

2. Estimation of Second Left-Side Expected Path and Second Right-Side Expected Path: 2-1. Calculation of Second Left-Side Expected Path Formula fL2 and Second Right-Side Expected Path Formula fR2

When the driving assistance ECU 10 determines that the host vehicle 100 is traveling straight, the driving assistance ECU 10 calculates a second left-side expected path formula fL2(n) and a second right-side expected path formula fR2(n) by General Formula (20) and General Formula (21). The second left-side expected path formula fL2(n) includes a second left-side expected path at the n-th cycle in the xy coordinate plane in a part thereof. The second right-side expected path formula fR2(n) includes a second right-side expected path at the n-th cycle in the xy coordinate plane in a part thereof.

Second left-side expected path formula $fL2(n)$:

$$y=w/2 \ (x\geq 0) \quad (20)$$

Second right-side expected path formula $fR2(n)$:

$$y=-w/2 \ (x\geq 0) \quad (21)$$

That is, the driving assistance ECU 10 calculates the second left-side expected path formula fL2(n) as a formula of a half line extending in the traveling direction TDv(n) of the host vehicle 100 from the left end OL(n) of the host vehicle 100. The driving assistance ECU 10 calculates the second right-side expected path formula fR2(n) as a formula of a half line extending in the traveling direction TDv(n) of the host vehicle 100 from the right end OR(n) of the host vehicle 100. The driving assistance ECU 10 stores the second expected path formulas fL2(n), fR2(n) in the RAM of the driving assistance ECU 10.

2-2. Setting of Length LL2 of Second Left-Side Expected Path and Length LR2 of Second Right-Side Expected Path The driving assistance ECU 10 sets a length LL2(n) of the second left-side expected path as the length (7 m in the present example) from the left end OL(n) of the host vehicle 100 to a predetermined left-side position (a point (w/2,7) in the present example), and sets a length LR2(n) of the second right-side expected path as the length (7 m in the present example) from the right end OR(n) of the host vehicle 100 to a predetermined right-side position (a point (−w/2,7) in the present example). The driving assistance ECU 10 stores the length LL2(n) and the length LR2(n) of each second expected path in the RAM of the driving assistance ECU 10.

Estimation of Expected Path of Object

Figure 4B:
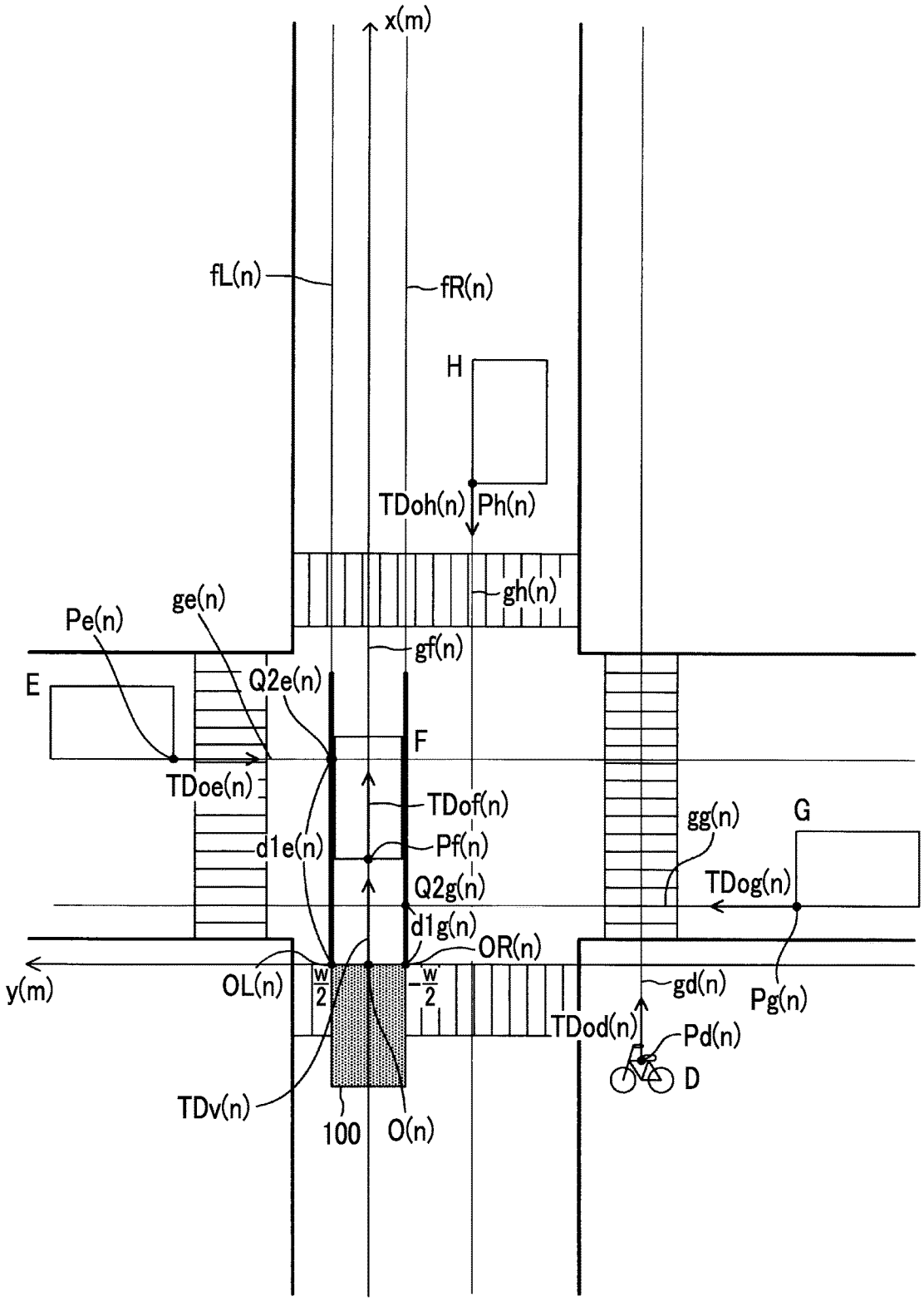
FIG. 4B is a diagram that illustrates an on-road positional relationship between the host vehicle and the object present around the host vehicle at the n-th cycle and is used for describing the presence or absence of the target object at the n-th cycle when the host vehicle travels straight.

The driving assistance ECU 10 estimates an expected path through which the object is expected to pass, based on the object information. The driving assistance ECU 10 calculates an expected path formula g(n) as a formula of a half line extending in the traveling direction TDo(n) of the object from the relative position P(n) of the object. The expected path formula g(n) represents the expected path of the object at the n-th cycle in the xy coordinate plane. A body A to a body C illustrated in FIG. 4A and a body D to a body H illustrated in FIG. 4B are physical bodies (that is, objects) that are present within the range of reach of the electromagnetic wave transmitted by each radar sensor 15 of the host vehicle 100 at the n-th cycle. In the example in FIG. 4A and FIG. 4B, the driving assistance ECU 10 calculates, based on the object information at the n-th cycle, an expected path formula gd(n) to an expected path formula gg(n) respectively extending in a traveling direction TDoa(n) of the object A to a traveling direction TDog(n) of the object H (refer to arrows in FIG. 4A and FIG. 4B) from a relative position Pa(n) of the object A to a relative position Pg(n) of the object H (hereinafter, the expected path formula g(n) will be simply referred to as a "formula g(n)"). The driving assistance ECU 10 stores the formula gd(n) to the formula gg(n) in the RAM of the driving assistance ECU 10.

Determination Condition when Host Vehicle 100 is Making Right Turn or Left Turn and Determination Condition when Host Vehicle 100 is Traveling Straight A "determination condition when the driving assistance ECU 10 determines that the host vehicle 100 is making a left turn or a right turn" employed by the driving assistance ECU 10 is partially different from a "determination condition when the driving assistance ECU 10 determines that the host vehicle 100 is traveling straight" employed by the driving assistance ECU 10. Hereinafter, the determination condition when the driving assistance ECU 10 determines that the host vehicle 100 is making a left turn or a right turn will be described, and then, the determination condition when the driving assistance ECU 10 determines that the host vehicle 100 is traveling straight will be described.

3. When Driving Assistance ECU 10 Determines that Host Vehicle 100 is Making Left Turn or Right Turn: 3-1. First Intersection Condition and Calculation of Coordinates of Intersection Q1

When the driving assistance ECU 10 determines that the host vehicle 100 is making a left turn or a right turn, the driving assistance ECU 10 determines whether or not a first intersection condition is established. The first intersection condition is that a line represented by the formula g(n) of the object (each of the formula ga(n) to the formula gc(n) in the present example) intersects with at least one of the first left-side expected path and the first right-side expected path of the host vehicle 100. In the present specification, "intersection of two lines" means that one line crosses the other line, and does not mean that two lines are connected. When the driving assistance ECU 10 determines that the first intersection condition is established, the driving assistance ECU 10 extracts the object as an object satisfying the first intersection condition. In such a case, the driving assistance ECU 10 calculates the number of intersections at which the line represented by the formula g(n) intersects with the first left-side expected path and/or the first right-side expected path. When the number of intersections is two, the driving assistance ECU 10 calculates, as the coordinates of an intersection Q1(n), the coordinates of the intersection at which the line represented by the formula g(n) intersects with the first left-side expected path or the first right-side expected path for the first time in the traveling direction TDo(n) of the object. When the number of intersections is one, the driving assistance ECU 10 calculates the coordinates of the intersection as the coordinates of the intersection Q1(n). When the driving assistance ECU 10 determines that the first intersection condition is not established, the driving assistance ECU 10 does not extract the object. The driving assistance ECU 10 stores the extraction result and the coordinates of the intersection Q1(n) in the RAM of the driving assistance ECU 10 in association with the object having the intersection Q1(n).

In the example in FIG. 4A, a line represented by the formula ga(n) for the object A intersects with the first left-side expected path illustrated by a bold solid line at a point A1 and intersects with the first right-side expected path illustrated by a bold solid line at a point A2. Thus, the number of intersections is two. A line represented by the formula gb(n) for the object B intersects with the first left-side expected path at a point B1. Thus, the number of intersections is one. Accordingly, the driving assistance ECU 10 determines that the first intersection condition is established for the object A and the object B, and extracts the object A and the object B as the object satisfying the first intersection condition. The driving assistance ECU 10 calculates the coordinates of the point A1, which is the intersection at which the line represented by the formula ga(n) intersects with the first left-side expected path or the first right-side expected path for the first time in the traveling direction TDoa(n) of the object A, as the coordinates of an intersection Q1a(n) for the object A and calculates the coordinates of the intersection B1 as the coordinates of an intersection Q1b(n) for the object B. A line represented by the formula gc(n) for the object C does not intersect with any of the first left-side expected path and the first right-side expected path. Thus, the driving assistance ECU 10 determines that the first intersection condition is not established for the object C, and does not extract the object C.

3-2. Calculation of First Time Period t1

When the driving assistance ECU 10 extracts an object as the object satisfying the first intersection condition, the driving assistance ECU 10 calculates a first time period t1(n) in which the object is expected to reach the first left-side expected path or the first right-side expected path. The driving assistance ECU 10 calculates the first time period t1(n) by dividing the length from the relative position P(n) of the object to the intersection Q1(n) by the speed SPDo(n) of the object. The driving assistance ECU 10 stores the first time period t1(n) in the RAM of the driving assistance ECU 10 in association with the object. In the example in FIG. 4A, the driving assistance ECU 10 calculates a first time period t1a(n) and a first time period t1b(n) respectively for the object A and the object B that are extracted as the object satisfying the first intersection condition. The first time period t1a(n) is calculated by dividing the length from the relative position Pa(n) of the object A to the intersection Q1a(n) by a speed SPDoa(n) of the object A. The first time period t1b(n) is calculated by the same method.

4. When Driving Assistance ECU 10 Determines that Host Vehicle 100 is Traveling Straight 4-1. Second Intersection Condition and Calculation of Coordinates of Intersection Q2

The driving assistance ECU 10 determines whether or not a second intersection condition is established. The second intersection condition is that the line represented by the formula g(n) of the object (each of the formula gd(n) to the formula gg(n) in the present example) intersects with both a line represented by the second left-side expected path formula fL2(n) and a line represented by the second right-side expected path formula fR2(n) of the host vehicle 100. When the driving assistance ECU 10 determines that the second intersection condition is established, the driving assistance ECU 10 extracts the object as an object satisfying the second intersection condition. The driving assistance ECU 10 calculates the coordinates of an intersection Q2(n) of the line represented by the formula g(n) of the extracted object and one of the lines represented by the second left-side expected path formula fL2(n) and the second right-side expected path formula fR2(n) with which the line represented by the formula g(n) intersects for the first time. When the driving assistance ECU 10 determines that the second intersection condition is not established, the driving assistance ECU 10 does not extract the object. The driving assistance ECU 10 stores the extraction result and the coordinates of the intersection Q2(n) in the RAM of the driving assistance ECU 10 in association with the object having the intersection Q2(n). As is apparent from the description, when the line represented by the formula g(n) of the object intersects with one of the two lines while the driving assistance ECU 10 determines that the host vehicle 100 is traveling straight (that is, when the relative position P(n) of the object having the traveling direction TDo(n) intersecting with the traveling direction TDv(n) of the host vehicle 100 is positioned between the two lines), the intersection conditions are not established.

In the example in FIG. 4B, a line represented by the formula ge(n) for the object E intersects with both of the lines represented by the second left-side expected path formula fL2(n) and the second right-side expected path formula fR2(n) of the host vehicle 100 and intersects with the line, of the lines, represented by the second left-side expected path formula fL2(n) for the first time at a point Q2e(n). A line represented by the formula gg(n) for the object G intersects both of the lines represented by the second left-side expected path formula fL2(n) and the second right-side expected path formula fR2(n) and intersects with the line, of the lines, represented by the second right-side expected path formula fR2(n) for the first time at a point Q2g(n). Accordingly, the driving assistance ECU 10 determines that the second intersection condition is established for the object E and the object and extracts the object E and the object G as the object satisfying the second intersection condition. The driving assistance ECU 10 calculates the coordinates of the intersection Q2e(n) for the object E and calculates the coordinates of the intersection Q2g(n) for the object G. Lines represented by the formula gd(n) for the object D, the formula gf(n) for the object F, and the formula gh(n) for the object H do not intersect with any of the lines represented by the second left-side expected path formula fL2(n) and the second right-side expected path formula fR2(n). Thus, the driving assistance ECU 10 determines that the second intersection condition is not established for the object D, the object F, and the object H, and does not extract the object D, the object F, and the object H.

4-2. Calculation of Distance d1 and Length Condition

When the driving assistance ECU 10 extracts an object as the object satisfying the second intersection condition, the driving assistance ECU 10 calculates a distance d1(n) [m] from the host vehicle 100 to the intersection Q2(n) for the object. When the intersection Q2(n) is positioned on a left-side expected path, the driving assistance ECU 10 calculates the distance d1(n) as the distance from the left end OL(n) of the host vehicle 100 to the intersection Q2(n). When the intersection Q2(n) is positioned on a right-side expected path, the driving assistance ECU 10 calculates the distance d1(n) as the distance from the right end OR(n) of the host vehicle 100 to the intersection Q2(n). The driving assistance ECU 10 stores the distance d1(n) in the RAM of the driving assistance ECU 10. The driving assistance ECU 10 determines whether or not a length condition is established. The length condition is that the distance d1(n) is less than or equal to the length of each second expected path of the host vehicle 100 (7 m in the present example). When the driving assistance ECU 10 determines that the length condition is established, the driving assistance ECU 10 extracts the object as an object satisfying the length condition. When the driving assistance ECU 10 determines that the length condition is not established, the driving assistance ECU 10 does not extract the object. The driving assistance ECU 10 stores the extraction result in the RAM of the driving assistance ECU 10.

In the example in FIG. 4B where the object E and the object G are extracted as the object satisfying the second intersection condition, a distance d1e(n) for the object E from the left end OL(n) of the host vehicle 100 to the intersection Q2e(n) is less than or equal to the length of the second left-side expected path (refer to a bold line in FIG. 4B). A distance d1g(n) for the object G from the right end OR(n) of the host vehicle 100 to the intersection Q2g(n) is less than or equal to the length of the second right-side expected path (refer to a bold line in FIG. 4B). Accordingly, the driving assistance ECU 10 determines that the length condition is established for both of the object E and the object and extracts the object E and the object G as the object satisfying the length condition.

4-3. Calculation of Second Time Period t2

When the driving assistance ECU 10 extracts an object as the object satisfying the length condition, the driving assistance ECU 10 calculates a second time period t2(n) in which the object is expected to reach the second left-side expected path or the second right-side expected path. The driving assistance ECU 10 calculates the second time period t2(n) by dividing the length from the relative position P(n) of the object to the intersection Q2(n) by the speed SPDo(n) of the object. The driving assistance ECU 10 stores the second time period t2(n) in the RAM of the driving assistance ECU 10 in association with the object. In the example in FIG. 4B, the driving assistance ECU 10 calculates a second time period t2e(n) and a second time period t2g(n) respectively for the object E and the object G that are extracted as the object satisfying the length condition. The second time period t2e(n) is calculated by dividing the length from a relative position Pe(n) of the object E to the intersection Q2e(n) by a speed SPDoe(n) of the object E. The second time period t2g(n) is calculated by the same method.

Time Period Condition

When the driving assistance ECU 10 determines that the host vehicle 100 is making a left turn or a right turn, or when the driving assistance ECU 10 determines that the host vehicle 100 is traveling straight, the driving assistance ECU 10 determines whether or not a time period condition is established. The time period condition is that the first time period t1(n) or the second time period t2(n) is less than or equal to a threshold time period (four seconds in the present example). When the driving assistance ECU 10 determines that the time period condition is established, the driving assistance ECU 10 extracts the object as an object satisfying the time period condition. When the driving assistance ECU 10 determines that the time period condition is not established, the driving assistance ECU 10 does not extract the object. The driving assistance ECU 10 stores the extraction result in the RAM of the driving assistance ECU 10.

When, for example, the first time period t1a(n) for the object A is three seconds and the first time period t1b(n) for the object B is six seconds in FIG. 4A, the first time period t1a(n) is less than or equal to the threshold time period. Thus, the driving assistance ECU 10 determines that the time period condition is established for the object A, and extracts the object A as the object satisfying the time period condition. The first time period t1b(n) exceeds the threshold time period. Thus, the driving assistance ECU 10 determines that the time period condition is not established for the object B, and does not extract the object B.

When, for example, the second time period t2e(n) for the object E is two seconds and the second time period t2g(n) for the object G is five seconds in FIG. 4B, the second time period t2e(n) is less than or equal to the threshold time period. Thus, the driving assistance ECU 10 determines that the time period condition is established for the object E, and extracts the object E as the object satisfying the time period condition. The second time period t2g(n) exceeds the threshold time period. Thus, the driving assistance ECU 10 determines that the time period condition is not established for the object and does not extract the object G.

Setting of Attention Calling Flag

When the driving assistance ECU 10 extracts an object as the object satisfying the time period condition, the driving assistance ECU 10 determines that the object is likely to cross the first left-side expected path and/or the first right-side expected path, or the second left-side expected path and/or the second right-side expected path within the threshold time period (in other words, determines that the object is the target object), and sets the value of the attention calling flag to 1 for the object. When the driving assistance ECU 10 does not extract an object as the object satisfying the first intersection condition or the time period condition while the driving assistance ECU 10 determines that the host vehicle 100 is making a right turn or a left turn, the driving assistance ECU 10 determines that the object is very unlikely to cross the first left-side expected path and/or the first right-side expected path within the threshold time period (in other words, determines that the object is not the target object), and sets the value of the attention calling flag to 0 for the object. When the driving assistance ECU 10 does not extract an object as the object satisfying the second intersection condition, the length condition, or the time period condition while the driving assistance ECU 10 determines that the host vehicle 100 is traveling straight, the driving assistance ECU 10 determines that the object is very unlikely to cross the second left-side expected path and/or the second right-side expected path within the threshold time period, and sets the value of the attention calling flag to 0 for the object. Hereinafter, the first left-side expected path and the second left-side expected path may be collectively referred to as a "left-side expected path". The first right-side expected path and the second right-side expected path may be collectively referred to as a "right-side expected path". The driving assistance ECU 10 retains the value of the attention calling flag set for each object in the RAM of the driving assistance ECU 10.

In the example in FIG. 4A, the driving assistance ECU 10 sets the value of the attention calling flag to 1 for the object A that is extracted as the object satisfying the time period condition. The driving assistance ECU 10 sets the value of the attention calling flag to 0 for the object C that is not extracted as the object satisfying the first intersection condition, and the object B that is not extracted as the object satisfying the time period condition.

In the example in FIG. 4B, the driving assistance ECU 10 sets the value of the attention calling flag to 1 for the object E that is extracted as the object satisfying the time period condition. The driving assistance ECU 10 sets the value of the attention calling flag to 0 for the object D, the object F, and the object H that are not extracted as the object satisfying the second intersection condition, and sets the value of the attention calling flag to 0 for the object G that is not extracted as the object satisfying the time period condition.

C. Operation Related to Front Space Determination

Next, operation related to the front space determination will be described. In the engine ON period, or each time the calculation time period Tcal elapses, the driving assistance ECU 10 determines whether or not an object followed by the host vehicle 100 is present within a rectangular region of a predetermined size present in front of the host vehicle 100. Hereinafter, the rectangular region will be referred to as a "front region". When the driving assistance ECU 10 determines that an object followed by the host vehicle 100 is present within the front region, the driving assistance ECU 10 determines that a space that allows the target object to pass in front of the host vehicle 100 is not present in front of the host vehicle 100, and sets the value of a front space flag to 0. Hereinafter, the "space that is in front of the host vehicle 100 and allows the target object to pass in front of the host vehicle 100" will be referred to as a "front space". When the driving assistance ECU 10 determines that an object followed by the host vehicle 100 is not present within the front region, the driving assistance ECU 10 determines that there is the front space, and sets the value of the front space flag to 1. Unlike the target object determination, the front space determination performs the same process when the driving assistance ECU 10 determines that the host vehicle 100 is making a left turn or a right turn, and when the driving assistance ECU 10 determines that the host vehicle 100 is traveling straight. Thus, hereinafter, a method of the front space determination will be more specifically described in an example where the driving assistance ECU 10 determines that the host vehicle 100 is traveling straight (refer to FIG. 5).

Front Presence Condition

The driving assistance ECU 10 determines whether or not an object is present in front of the host vehicle 100 based on the object information. Specifically, the driving assistance ECU 10 determines whether or not a front presence condition is established. The front presence condition is that the value of the x coordinate of the relative position P(n) of the object satisfies $0 \leq x$. When the driving assistance ECU 10 determines that the front presence condition is established, the driving assistance ECU 10 determines that the object is present in front of the host vehicle 100, and extracts the object as an object satisfying the front presence condition. When the driving assistance ECU 10 determines that the front presence condition is not established, the driving assistance ECU 10 determines that the object is not present in front of the host vehicle 100, and does not extract the object. The driving assistance ECU 10 stores the extraction result in the RAM of the driving assistance ECU 10.

Figure 5:
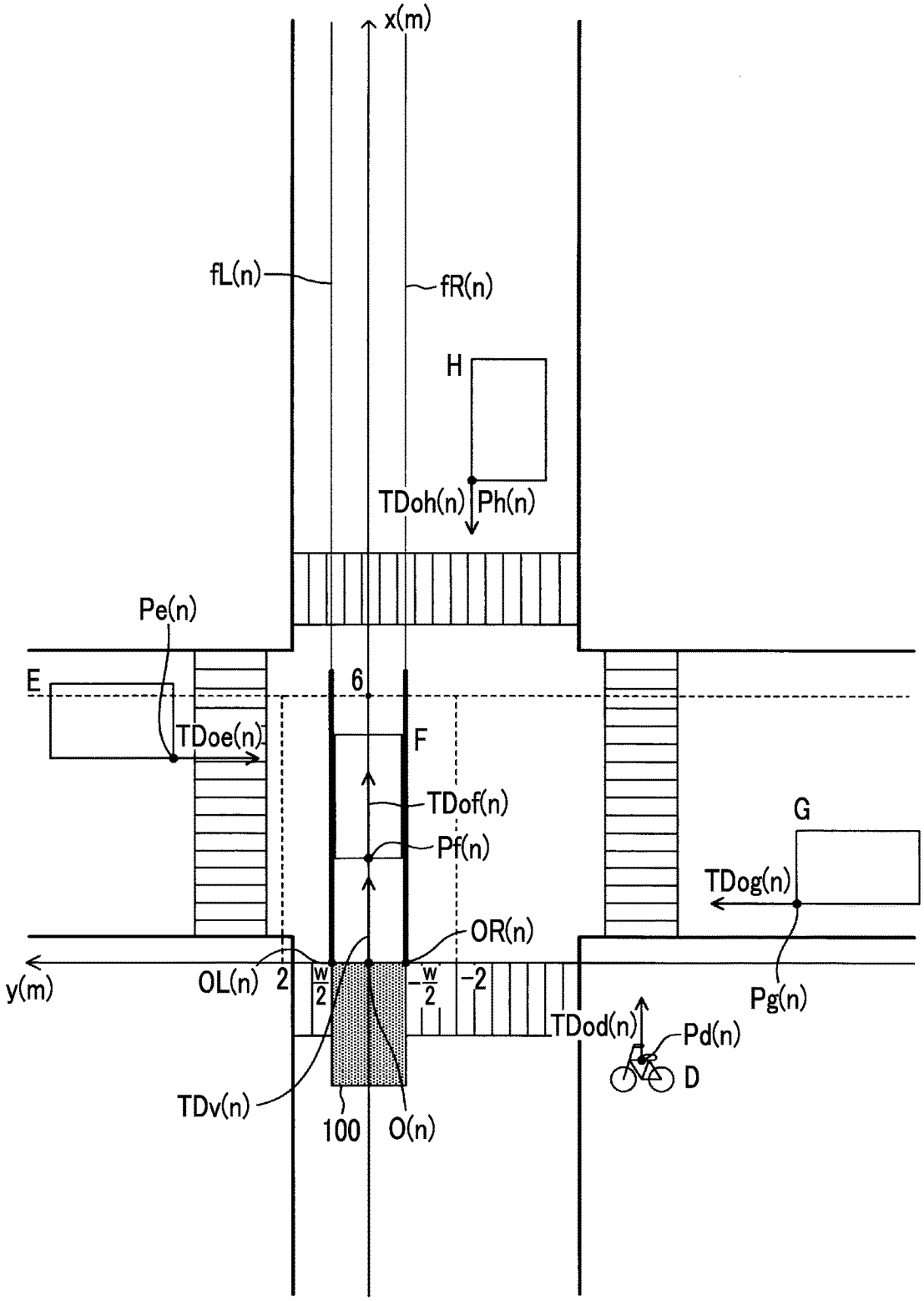
FIG. 5 is a diagram that illustrates the host vehicle and the object having the same positional relationship as in FIG. 4B and is used for describing the presence or absence of a front space at the n-th cycle.

In the example in FIG. 5 where the object D to the object H is present around the host vehicle 100, the x coordinate of any of the relative position Pe(n) of the object E to a relative position Ph(n) of the object H has a positive value. Accordingly, the driving assistance ECU 10 determines that the front presence condition is established for the object E to the object H, and extracts the object E to the object H as the object satisfying the front presence condition. The x coordinate of a relative position Pd(n) of the object D has a negative value. Thus, the driving assistance ECU 10 determines that the front presence condition is not established for the object D, and does not extract the object D.

Front and Rear Distance Condition

When the driving assistance ECU 10 extracts an object as the object satisfying the front presence condition, the driving assistance ECU 10 determines whether or not a front and rear distance d2(n) [m] is less than or equal to a predetermined front and rear distance threshold (6 m in the present example) based on the object information of the extracted object. The front and rear distance d2(n) is the distance from the host vehicle 100 to the extracted object in a front-rear direction (that is, the x-axis direction). Specifically, the driving assistance ECU 10 determines whether or not a front and rear distance condition is established. The front and rear distance condition is that the value of the x coordinate of the relative position P(n) of the object satisfies $0 \leq x \leq 6$. When the driving assistance ECU 10 determines that the front and rear distance condition is established, the driving assistance ECU 10 determines that the front and rear distance d2(n) from the host vehicle 100 to the extracted object is less than or equal to the front and rear distance threshold, and extracts the object as an object satisfying the front and rear distance condition. When the driving assistance ECU 10 determines that the front and rear distance condition is not established (that is, when the driving assistance ECU 10 determines that the value of the x coordinate of the relative position P(n) of the object satisfies $6<x$), the driving assistance ECU 10 determines that the front and rear distance d2(n) from the host vehicle 100 to the extracted object is greater than the front and rear distance threshold, and does not extract the object. The driving assistance ECU 10 stores the extraction result in the RAM of the driving assistance ECU 10. The front and rear distance threshold is set to be less than or equal to the lengths of the second left-side expected path and the second right-side expected path of the host vehicle 100 (7 m in the present example).

In the example in FIG. 5 where the object E to the object H are extracted as the object satisfying the front presence condition, the value of the x coordinate of any of the relative position Pe(n) of the object E to the relative position Pg(n) of the object G satisfies $0 \leq x \leq 6$. Accordingly, the driving assistance ECU 10 determines that the front and rear distance condition is established for the object E to the object and extracts the object E to the object G as the object satisfying the front and rear distance condition. The value of the x coordinate of the relative position Ph(n) of the object H satisfies $6<x$. Thus, the driving assistance ECU 10 determines that the front and rear distance condition is not established for the object H, and does not extract the object H.

Horizontal Distance Condition

When the driving assistance ECU 10 extracts an object as the object satisfying the front and rear distance condition, the driving assistance ECU 10 determines whether or not a horizontal distance d3(n) [m] is less than or equal to a predetermined horizontal distance threshold (2 m in the present example) based on the object information of the extracted object. The horizontal distance d3(n) is the distance from the host vehicle 100 to the extracted object in the horizontal direction (that is, the y-axis direction). Specifically, the driving assistance ECU 10 determines whether or not a horizontal distance condition is established. The horizontal distance condition is that the absolute value of the y coordinate of the relative position P(n) of the object is less than or equal to two. When the driving assistance ECU 10 determines that the horizontal distance condition is established, the driving assistance ECU 10 determines that the horizontal distance d3(n) from the host vehicle 100 to the extracted object is less than or equal to the horizontal distance threshold, and extracts the object as an object satisfying the horizontal distance condition. When the driving assistance ECU 10 determines that the horizontal distance condition is not established (that is, when the driving assistance ECU 10 determines that the absolute value of the y coordinate of the relative position P(n) of the object is greater than two), the driving assistance ECU 10 determines that the horizontal distance d3(n) from the host vehicle 100 to the extracted object is greater than the horizontal distance threshold, and does not extract the object. The driving assistance ECU 10 stores the extraction result in the RAM of the driving assistance ECU 10. By determining whether or not each of the front presence condition, the front and rear distance condition, and the horizontal distance condition is established, the driving assistance ECU 10 can determine whether or not an object is present within a rectangular region that is present in front of the host vehicle 100 and satisfies $0 \leq x \leq 6$ and $-2 \leq y \leq 2$ (that is, the front region).

In the example in FIG. 5 where the object E to the object G are extracted as the object satisfying the front and rear distance condition, the absolute value of the y coordinate of a relative position Pf(n) of the object F is less than or equal to two. Accordingly, the driving assistance ECU 10 determines that the horizontal distance condition is established for the object F, and extracts the object F as the object satisfying the horizontal distance condition. The absolute value of the y coordinate of the relative position Pe(n) of the object E and the absolute value of the y coordinate of the relative position Pg(n) of the object G are greater than two. Thus, the driving assistance ECU 10 determines that the horizontal distance condition is not established for the object E and the object and does not extract the object E and the object G. That is, in the example in FIG. 5, the driving assistance ECU 10 determines that the object F is present in the front region.

Horizontal Speed Condition

When the driving assistance ECU 10 extracts an object as the object satisfying the horizontal distance condition, the driving assistance ECU 10 determines whether or not the traveling direction TDo(n) of the object is approximately parallel to the traveling direction TDv(n) of the host vehicle 100 based on the object information of the extracted object. Specifically, the driving assistance ECU 10 determines whether or not a horizontal speed condition is established. The horizontal speed condition is that a horizontal-direction speed (hereinafter, referred to as a "horizontal speed") SPDoy(n) of the object is less than or equal to a predetermined horizontal speed threshold (5 km/h in the present example). The horizontal speed SPDoy(n) of the object is calculated as the y component of a speed vector of the object that has a magnitude of the speed SPDo(n) of the object and has a direction of the traveling direction TDo(n) of the object. When the driving assistance ECU 10 determines that the horizontal speed condition is established (that is, when the driving assistance ECU 10 determines that SPDoy(n) 5 is satisfied), the driving assistance ECU 10 determines that the traveling direction TDo(n) of the object is approximately parallel to the traveling direction TDv(n) of the host vehicle 100, and extracts the object as an approximately parallel object satisfying the horizontal speed condition. When the driving assistance ECU 10 determines that the horizontal speed condition is not established (that is, when the driving assistance ECU 10 determines that $5<SPDoy(n)$ is satisfied), the driving assistance ECU 10 determines that the traveling direction TDo(n) of the object intersects with the traveling direction TDv(n) of the host vehicle 100, and does not extract the object. The driving assistance ECU 10 stores the extraction result in the RAM of the driving assistance ECU 10.

When an object present in the front region is an object that crosses the front region at a comparatively high speed, the object passes through the front region in a comparatively short period of time. Thus, the object may not be the object followed by the host vehicle 100. The object is considered as an object that is a target of calling attention as the target object before the object enters the front region. However, in determination of the front presence condition, the front and rear distance condition, and the horizontal distance condition, all objects that are determined to be present in the front region are extracted as the object satisfying each condition, and the extracted objects include an object that crosses the front region at a comparatively high speed. Thus, by determining whether or not the horizontal speed condition is established, an object that crosses the front region at a horizontal speed greater than the horizontal speed threshold can be excluded (not set as a target of extraction) from the objects determined to be present in the front region. Accordingly, the driving assistance ECU 10 can appropriately extract an object that is present in the front region and has the horizontal speed SPDoy(n) less than or equal to the horizontal speed threshold (that is, the approximately parallel object; in other words, an object that is comparatively likely to be followed by the host vehicle 100).

In the example in FIG. 5, it is assumed that the horizontal speed SPDoy(n) of the object F extracted as the object satisfying the horizontal distance condition is 0 km/h. In such a case, the driving assistance ECU 10 determines that the horizontal speed condition is established for the object F, and extracts the object F as the approximately parallel object satisfying the horizontal speed condition.

Setting of Followed Flag

When the driving assistance ECU 10 extracts an object as the approximately parallel object satisfying the horizontal speed condition, the driving assistance ECU 10 determines that the approximately parallel object is followed by the host vehicle 100 within the front region of the host vehicle 100, and sets the value of a followed flag to 1 for the approximately parallel object. Hereinafter, the "object followed by the host vehicle 100" will be referred to as a "followed object". When the driving assistance ECU 10 does not extract an object as the object satisfying the front presence condition, the front and rear distance condition, the horizontal distance condition, or the horizontal speed condition, the driving assistance ECU 10 determines that the object is not the followed object, and sets the value of the followed flag to 0 for the object. The driving assistance ECU 10 stores the value of the followed flag set for each object in the RAM of the driving assistance ECU 10.

In the example in FIG. 5, the driving assistance ECU 10 sets the value of the followed flag to 1 for the object F that is extracted as the object satisfying the horizontal speed condition. The driving assistance ECU 10 sets the value of the followed flag to 0 for each of the object D that is not extracted as the object satisfying the front presence condition, the object H that is not extracted as the object satisfying the front and rear distance condition, and the object E and the object G that are not extracted as the object satisfying the horizontal distance condition.

Setting of Front Space Flag

When the driving assistance ECU 10 sets the value of the followed flag by determining whether or not each condition described above is established for all objects present around the host vehicle 100, the driving assistance ECU 10 determines whether or not an object having the value of the followed flag set to 1 is present (that is, whether or not the followed object is present within the front region). When the driving assistance ECU 10 determines that an object having the value of the followed flag equal to 1 is present (that is, the followed object is present within the front region), the driving assistance ECU 10 determines that there is no the front space (that is, a space that is in front of the host vehicle 100 and allows the target object to pass in front of the host vehicle 100), and sets the value of the front space flag to 0. When the driving assistance ECU 10 determines that an object having the value of the followed flag equal to 1 is not present (that is, the followed object is not present within the front region), the driving assistance ECU 10 determines that there is the front space, and sets the value of the front space flag to 1. The driving assistance ECU 10 stores the set value of the front space flag in the RAM of the driving assistance ECU 10.

In the example in FIG. 5, the driving assistance ECU 10 sets the followed flag by determining whether or not each condition described above is established for the object D to the object H that are all objects present around the host vehicle 100. Then, the driving assistance ECU 10 determines whether or not an object having the value of the followed flag equal to 1 is present. As described above, the value of the followed flag of the object F is 1. Thus, the driving assistance ECU 10 determines that there is no front space in the front region, and sets the value of the front space flag to 0.

D. Operation Related to Attention Calling Determination

Next, operation related to an attention calling determination will be described. In the engine ON period, or each time the calculation time period Tcal elapses, the driving assistance ECU 10 determines whether or not attention has to be called for each object based on the determination result of the target object determination in B (that is, the value of the attention calling flag) and the determination result of the front space determination in C (that is, the value of the front space flag). Hereinafter, the attention calling determination will be specifically described. In the engine ON period, the driving assistance ECU 10 determines whether or not attention has to be called, even when the vehicle speed SPDv of the host vehicle 100 is zero.

When Attention is Called

Specifically, when the driving assistance ECU 10 determines that the value of the attention calling flag of any object is 1 and that the value of the front space flag of the object is 1, the driving assistance ECU 10 determines that "since the target object is present and there is the front space, the target object passes through the front space and is consequently likely to cross the left-side expected path and/or the right-side expected path of the host vehicle 100", generates the request signal, and calls attention to the target object by using the display device 21.

When Attention Calling is Forbidden

When the driving assistance ECU 10 determines that the value of the attention calling flag of any object is 1 and that the value of the front space flag of the object is 0, the driving assistance ECU 10 determines that "since there is no front space even though the target object is present, the target object is very unlikely to cross the left-side expected path and/or the right-side expected path of the host vehicle 100", forbids generation of the request signal, and accordingly, forbids calling attention to the target object.

When Attention is not Called

When the driving assistance ECU 10 determines that the value of the attention calling flag of all objects is 0, the driving assistance ECU 10 determines that the target object is not present (that is, the object is not the target object)

regardless of the value of the front space flag, does not generate the request signal, and accordingly, does not call attention.

Specific Operation of Present Embodied Apparatus

Next, specific operation of the present embodied apparatus will be described. In the engine ON period, the CPU of the driving assistance ECU 10 of the present embodied apparatus executes routines illustrated in flowcharts in FIG. 6 to FIG. 8 each time the calculation time period Tcal elapses. Hereinafter, the CPU of the driving assistance ECU 10 will be simply referred to as a "CPU".

Figure 6:
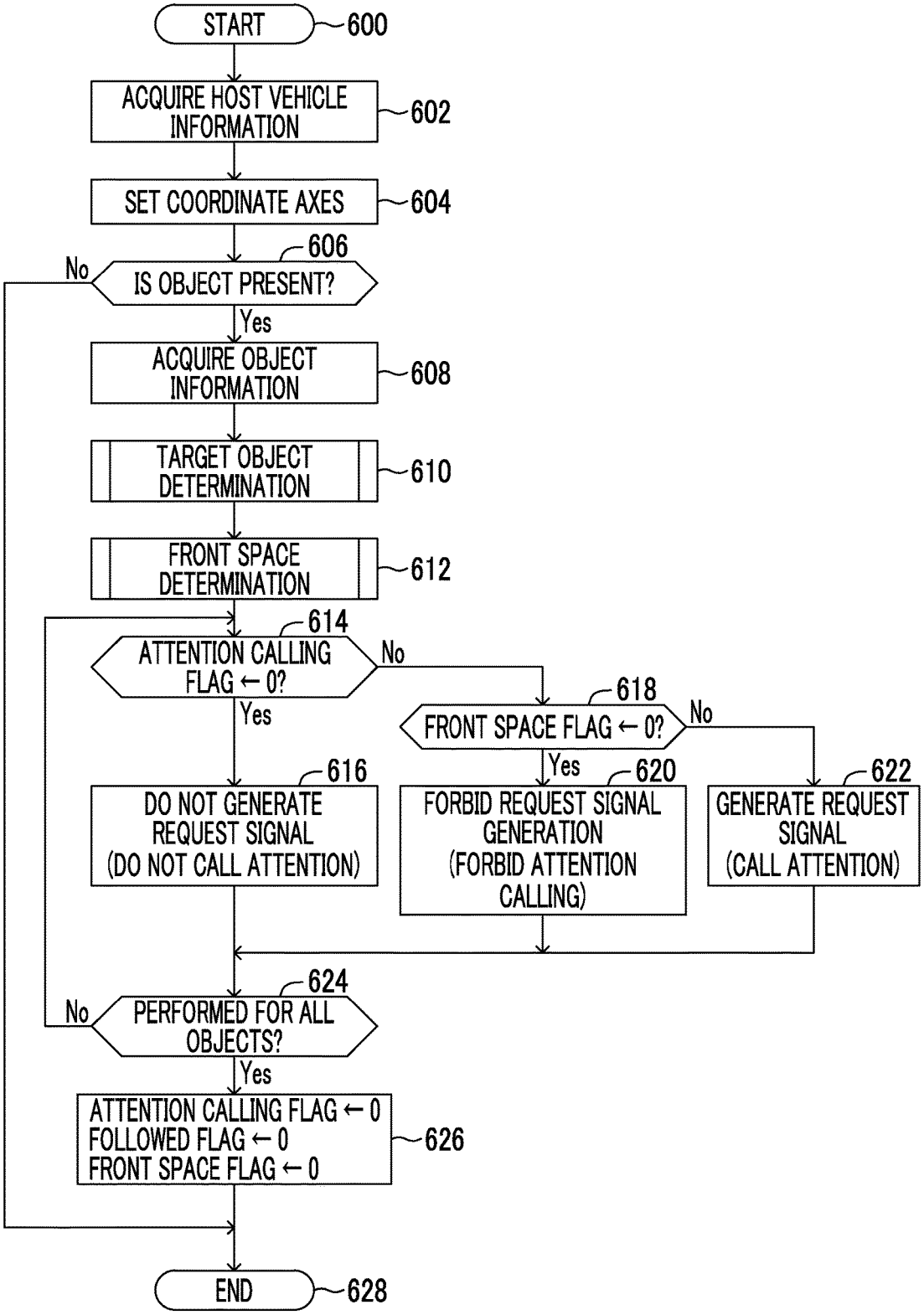
FIG. 6 is a flowchart (1) illustrating a routine executed by a CPU of a driving assistance ECU of the present embodied apparatus (hereinafter, referred to as a "CPU of the present embodied apparatus")

When a predetermined timing arrives, the CPU starts from a process of step 600 in FIG. 6 and performs processes of step 602 and step 604 in order.

Step 602: The CPU acquires the host vehicle information (the vehicle speed SPDv(n), the yaw rate Y(n), and the like) of the host vehicle 100 as described above and stores the host vehicle information in the RAM of the driving assistance ECU 10.

Step 604: The CPU determines the traveling direction TDv(n) of the host vehicle 100 based on the host vehicle information acquired in step 602. The CPU sets the coordinate axes (the x axis and the y axis) as described above and stores information representing the coordinate axes in the RAM of the driving assistance ECU 10.

Next, the CPU transitions to step 606 and determines whether or not an object is present around the host vehicle 100. When the CPU determines that an object is not present, the CPU makes a "No" determination in step 606, transitions to step 628, and temporarily finishes the present routine. When the CPU determines that an object is present, the CPU makes a "Yes" determination in step 606 and transitions to step 608 below.

Step 608: The CPU acquires the object information of the object (the coordinates of the relative position P(n), the traveling direction TDo(n), and the speed SPDo(n) of the object) as described above and stores the object information in the RAM of the driving assistance ECU 10 (refer to General Formula (4) and General Formula (5)).

Next, the CPU transitions to step 610 and performs the target object determination process. Next, the CPU transitions to step 612 and performs the front space determination process. The CPU may perform the process of step 610 after performing the process of step 612, or may perform the process of step 612 in parallel with the process of step 610.

Figure 7A:
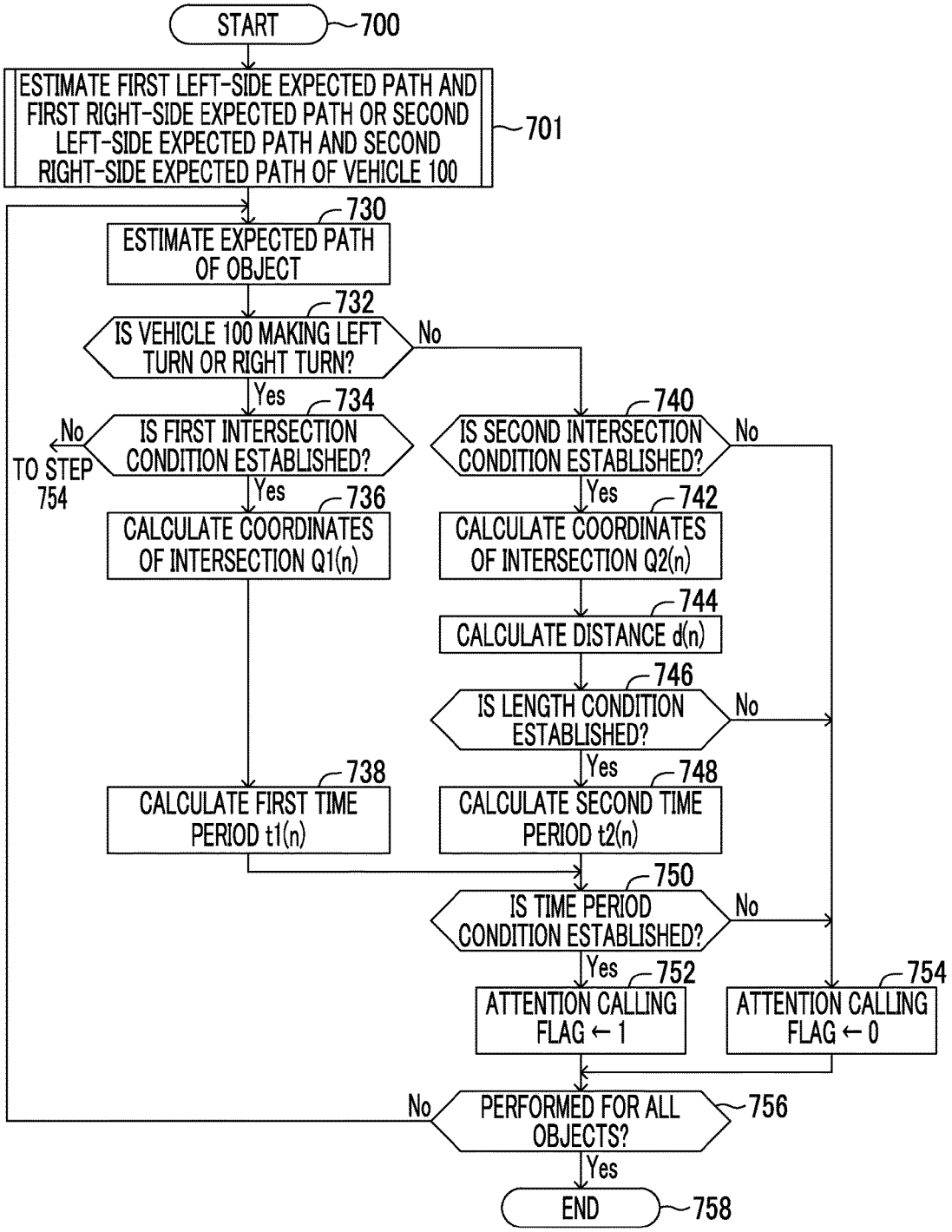
FIG. 7A is a flowchart (2) illustrating a routine executed by the CPU of the present embodied apparatus.

In the routine in FIG. 6, the CPU in step 610 executes the routine illustrated in the flowchart in FIG. 7A. When the CPU transitions to step 610, the CPU starts from a process of step 700 in FIG. 7A and performs a process of step 701 below.

Figure 7B:
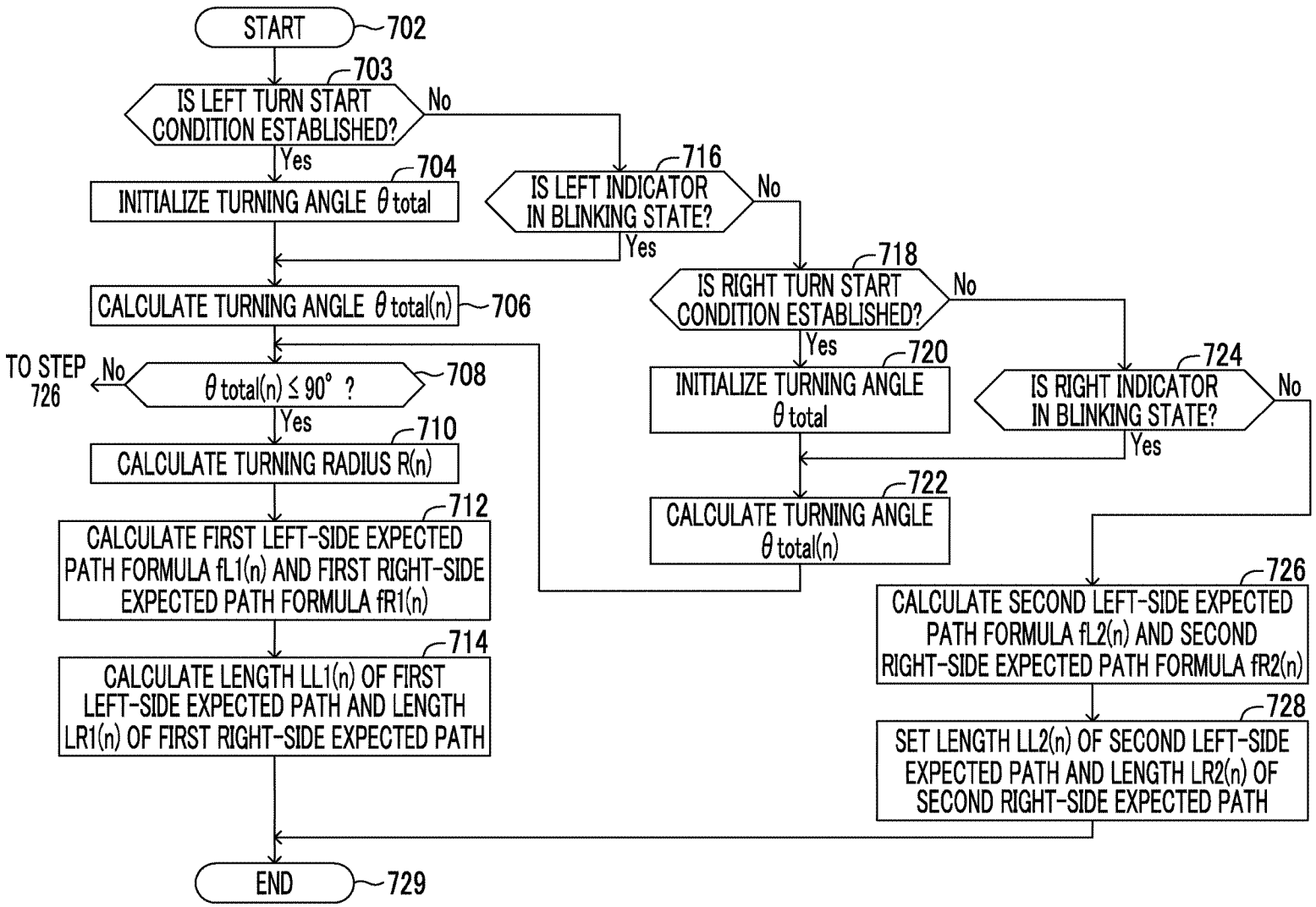
FIG. 7B is a flowchart (3) illustrating a routine executed by the CPU of the present embodied apparatus.

In the routine in FIG. 7A, the CPU in step 701 estimates the "first left-side expected path and the first right-side expected path" or the "second left-side expected path and the second right-side expected path" described above by executing the routine illustrated in the flowchart in FIG. 7B. That is, when the CPU transitions to step 701, the CPU starts from a process of step 702 in FIG. 7B and transitions to step 703 below.

In step 703, the CPU determines whether or not the left turn start condition is established based on the host vehicle information acquired in step 602 in FIG. 6. When the CPU determines that the left turn start condition is established, the CPU makes a "Yes" determination in step 703 (that is, determines that the host vehicle 100 starts to make a left turn) and performs processes of step 704 and step 706 below in order.

Step 704: The CPU initializes the turning angle θtotal to 0° (refer to General Formula (6)). The turning angle θtotal is initialized once when the left turn start condition is established, and then, is not initialized before the host vehicle 100 finishes the left turn.

Step 706: The CPU calculates the turning angle θtotal(n) of the host vehicle 100 from the m-th cycle to the n-th cycle as described above (refer to General Formula (7)) and stores the turning angle θtotal(n) in the RAM of the driving assistance ECU 10.

Next, the CPU transitions to step 708 and determines whether or not the turning angle θtotal(n) calculated in step 706 satisfies θtotal(n)≤90°. When the CPU determines that θtotal(n)≤90° is established, the CPU makes a "Yes" determination in step 708 (that is, determines that the host vehicle 100 is making a left turn) and performs processes of step 710 to step 714 below in order. When the CPU determines that turning angle θtotal>90° is satisfied, the CPU makes a "No" determination in step 708 (that is, determines that the host vehicle 100 finishes the left turn and is traveling straight) and transitions to step 726 described below.

Step 710: The CPU calculates the turning radius R(n) by using the method described above and stores the turning radius R(n) in the RAM of the driving assistance ECU 10.

Step 712: The CPU calculates the center coordinates (Cx(n),Cy(n)) (refer to General Formula (8) and General Formula (13)), the left-side turning radius RL(n) (refer to General Formula (10)), and the right-side turning radius RR(n) (refer to General Formula (15)) as described above based on the turning radius R(n) calculated in step 710. The CPU calculates the first left-side expected path formula fL1(n) and the first right-side expected path formula fR1(n) by using the center coordinates (Cx(n),Cy(n)), the left-side turning radius RL(n), and the right-side turning radius RR(n) (refer to General Formula (12) and General Formula (17)) and stores the first left-side expected path formula fL1(n) and the first right-side expected path formula fR1(n) in the RAM of the driving assistance ECU 10.

Step 714: The CPU calculates the length LL1(n) of the first left-side expected path based on the turning angle θtotal(n) calculated in step 706 and the left-side turning radius RL(n) that is calculated based on the turning radius R(n) calculated in step 710 (refer to General Formula (18)). The CPU calculates the length LR1(n) of the first right-side expected path based on the turning angle θtotal(n) calculated in step 706 and the right-side turning radius RR(n) that is calculated based on the turning radius R(n) calculated in step 710 (refer to General Formula (19)). The CPU stores the first left-side expected path formula fL1(n) and the first right-side expected path formula fR1(n) in the RAM of the driving assistance ECU 10. When the CPU finishes the process of step 714, the CPU transitions to step 730 in FIG. 7A through step 729.

When the CPU determines that the left turn start condition is not established at a point in time when the CPU executes the process of step 703, the CPU makes a "No" determination in step 703 and transitions to step 716 below. The CPU makes a "No" determination in step 703 in the following cases.

The CPU performs the determination of step 703 after the CPU determines that the left turn start condition is established for the first time after the previous left turn or the previous right turn determined to be finished.

The left turn start condition is not established once after the CPU determines that the previous left turn or the previous right turn is finished.

It is assumed that the CPU performs the determination of step 703 after the CPU determines that the left turn start condition is established for the first time after the previous left turn or the previous right turn determined to be finished, and that the CPU consequently makes a "No" determination in step 703. Furthermore, it is assumed that the driver intends to start to make a left turn and thus, maintains the left indicator in the blinking state. In such a case, the CPU makes a "Yes" determination in step 716 and transitions to step 706 described above. When the CPU finishes the process of step 706, the CPU performs the processes of step 708 to step 714 described above in order and then, transitions to step 730 in FIG. 7A through step 729.

When the left turn start condition is not established once with the left indicator not in the blinking state after the previous left turn or the previous right turn determined to be finished (No in step 703), or when the CPU performs the determination of step 703 after the CPU determines that the left turn start condition is established for the first time after the previous left turn or the previous right turn determined to be finished, and consequently makes a "No" determination in step 703 with the left indicator not in the blinking state, the CPU makes a "No" determination in step 716 and transitions to step 718.

In step 718, the CPU determines whether or not the right turn start condition is established based on the host vehicle information acquired in step 602 in FIG. 6. When the CPU determines that the right turn start condition is established, the CPU makes a "Yes" determination in step 718 (that is, determines that the host vehicle 100 starts to make a right turn) and performs processes of step 720 and step 722 below in order.

Step 720: The CPU performs the same process as step 704. The CPU initializes the turning angle θtotal to 0° (refer to General Formula (6)). The turning angle θtotal is initialized once when the right turn start condition is established, and then, is not initialized before the host vehicle 100 finishes the right turn.

Step 722: The CPU performs the same process as step 706. The CPU calculates the turning angle θtotal(n) of the host vehicle 100 (refer to General Formula (7)) and stores the turning angle θtotal(n) in the RAM of the driving assistance ECU 10.

Next, the CPU transitions to step 708 and determines whether or not the turning angle θtotal(n) calculated in step 722 satisfies θtotal(n)≤90°. When the CPU determines that θtotal(n)≤90° is established, the CPU makes a "Yes" determination in step 708 (that is, determines that the host vehicle 100 is making a right turn) and performs the processes of step 710 to step 714 in order. When the CPU determines that turning angle θtotal>90° is satisfied, the CPU makes a "No" determination in step 708 (that is, determines that the host vehicle 100 finishes the right turn and is traveling straight) and transitions to step 726 described below.

Step 710: The CPU calculates the turning radius R(n) by using the method described above and stores the turning radius R(n) in the RAM of the driving assistance ECU 10.

Step 712: The CPU calculates the center coordinates (Cx(n),Cy(n)) (refer to General Formula (9) and General Formula (14)), the left-side turning radius RL(n) (refer to General Formula (11)), and the right-side turning radius RR(n) (refer to General Formula (16)) as described above based on the turning radius R(n) calculated in step 710. The CPU calculates the first left-side expected path formula fL1(n) and the first right-side expected path formula fR1(n), which are formulas of circles, by using the center coordinates (Cx(n),Cy(n)), the left-side turning radius RL(n), and the right-side turning radius RR(n) (refer to General Formula (12) and General Formula (17)) and stores the first left-side expected path formula fL1(n) and the first right-side expected path formula fR1(n) in the RAM of the driving assistance ECU 10.

Step 714: The CPU calculates the length LL1(n) of the first left-side expected path and the length LR1(n) of the first right-side expected path (refer to General Formula (18) and General Formula (19)) and stores the length LL1(n) and the length LR1(n) in the RAM of the driving assistance ECU 10. When the CPU finishes the process of step 714, the CPU transitions to step 730 in FIG. 7A through step 729.

When the CPU determines that the right turn start condition is not established at a point in time when the CPU executes the process of step 718, the CPU makes a "No" determination in step 718 and transitions to step 724 below. When the CPU makes a "No" determination in step 718, the CPU makes a "No" determination in step 716 described above, and the following states occur.

The CPU performs the determination of step 718 after the CPU determines that the right turn start condition is established for the first time after the previous left turn or the previous right turn determined to be finished.

The right turn start condition is not established once after the CPU determines that the previous left turn or the previous right turn is finished.

It is assumed that the CPU performs the determination of step 718 after the CPU determines that the right turn start condition is established for the first time after the previous left turn or the previous right turn determined to be finished, and that the CPU consequently makes a "No" determination in step 718. Furthermore, it is assumed that the driver intends to start to make a right turn and thus, maintains the right indicator in the blinking state. In such a case, the CPU makes a "Yes" determination in step 724 and transitions to step 722 described above. When the CPU finishes the process of step 722, the CPU performs the processes of step 708 to step 714 described above in order and then, transitions to step 730 in FIG. 7A through step 729.

When the right turn start condition is not established once with the right indicator not in the blinking state after the previous left turn or the previous right turn determined to be finished (No in step 718), or when the CPU performs the determination of step 718 after the CPU determines that the right turn start condition is established for the first time after the previous left turn or the previous right turn determined to be finished, and consequently makes a "No" determination in step 718 with the right indicator not in the blinking state, the CPU makes a "No" determination in step 724 (that is, the CPU determines that the host vehicle 100 is traveling straight) and performs processes of step 726 and step 728 below in order.

Step 726: The CPU calculates the second left-side expected path formula fL2(n) and the second right-side expected path formula fR2(n), which are formulas of half lines, as described above (refer to General Formula (20) and General Formula (21)) and stores the second left-side expected path formula fL2(n) and the second right-side expected path formula fR2(n) in the RAM of the driving assistance ECU 10.

Step 728: The CPU sets each of the length LL2(n) of the second left-side expected path and the length LR2(n) of the second right-side expected path to 7 m and stores the length LL2(n) and the length LR2(n) in the RAM of the driving assistance ECU 10. When the CPU finishes the process of step 728, the CPU transitions to step 730 in FIG. 7A through step 729.

When the CPU transitions to step 730 in FIG. 7A, the CPU selects any one object from the objects having the object information acquired in step 608 in FIG. 6 and estimates the expected path of the selected object in the xy coordinate plane (in other words, calculates the expected path formula g(n)). The CPU stores the expected path formula g(n) in the RAM of the driving assistance ECU 10 in association with the object. The CPU performs the processes from step 730 to step 754 described below for each selected object (refer to step 756 described below).

Next, the CPU transitions to step 732 and determines whether or not the host vehicle 100 is making a left turn or a right turn based on the determination result of step 703, step 716, step 718, and/or step 724 in FIG. 7B. When the CPU determines that the host vehicle 100 is making a left turn or a right turn, the CPU makes a "Yes" determination in step 732 and transitions to step 734.

In step 734, the CPU determines whether or not the first intersection condition is established for the object selected in step 730. When the CPU determines that the first intersection condition is established, the CPU makes a "Yes" determination in step 734 and performs processes of step 736 and step 738 below in order.

Step 736: For the object for which the CPU in step 734 determines that the first intersection condition is established, the CPU calculates the coordinates of the intersection Q1(n) at which the line represented by the formula g(n) intersects with the first left-side expected path or the first right-side expected path having an arc shape, and stores the coordinates in the RAM of the driving assistance ECU 10 in association with the object.

Step 738: The CPU calculates, as described above, the first time period t1(n) in which the object is expected to reach the intersection Q1(n), and stores the first time period t1(n) in the RAM of the driving assistance ECU 10 in association with the object. Then, the CPU transitions to step 750 described below.

When the CPU determines that the host vehicle 100 is not making a left turn or a right turn at a point in time when the CPU executes the process of step 732 (that is, when the CPU determines that the host vehicle 100 is traveling straight), the CPU makes a "No" determination in step 732 and transitions to step 740.

In step 740, the CPU determines whether or not the second intersection condition is established for the object selected in step 730. When the CPU determines that the second intersection condition is established, the CPU makes a "Yes" determination in step 740 and performs processes of step 742 and step 744 below in order.

Step 742: For the object for which the CPU in step 740 determines that the second intersection condition is established, the CPU calculates the coordinates of the intersection Q2(n) of the line represented by the formula g(n) and one of the lines represented by the second left-side expected path formula fL2(n) and the second right-side expected path formula fR2(n) having a linear shape with which the line represented by the formula g(n) intersects for the first time, and stores the coordinates in the RAM of the driving assistance ECU 10 in association with the object.

Step 744: The CPU calculates the distance d1(n) from the host vehicle 100 to the intersection Q2(n) calculated in step 742 and stores the distance d1(n) in the RAM of the driving assistance ECU 10 in association with the object.

Next, the CPU transitions to step 746 and determines, by using the distance d1(n) calculated in step 744, whether or not the length condition (d1(n)≤length of each second expected path (7 m in the present example)) is established for the object for which the CPU in step 740 determines that the second intersection condition is established. When the CPU determines that the length condition is established, the CPU makes a "Yes" determination in step 746 and performs a process of step 748 below.

Step 748: The CPU calculates, as described above, the second time period t2(n) in which the object is expected to reach the intersection Q2(n), and stores the second time period t2(n) in the RAM of the driving assistance ECU 10 in association with the object. Then, the CPU transitions to step 750 below.

When the CPU transitions to step 750 after calculating the first time period t1(n) in step 738, the CPU determines whether or not the time period condition (t1(n) threshold time period (4 s in the present example)) is established for the object for which the CPU in step 734 determines that the first intersection condition is established. When the CPU transitions to step 750 after calculating the second time period t2(n) in step 748, the CPU determines whether or not the time period condition (t2(n)≤threshold time period (4 s in the present example)) is established for the object for which the CPU in step 746 determines that the length condition is established. In either case, when the CPU determines that the time period condition is established, the CPU makes a "Yes" determination in step 750 and performs a process of step 752 below.

Step 752: The CPU sets the value of the attention calling flag to 1 for the object and stores the set value in the RAM of the driving assistance ECU 10 in association with the object. Then, the CPU transitions to step 756 described below.

When the CPU in step 734 determines that the first intersection condition is not established, or when the CPU in step 750 determines that the time period condition is not established, the CPU determines that the object does not approach from the left side or the right side of the host vehicle 100 (in other words, the CPU determines that the object is very unlikely to cross the first left-side expected path and/or the first right-side expected path having an arc shape within the threshold time period), makes a "No" determination in any of step 734 and step 750, and performs a process of step 754 described below.

When the CPU in step 740 determines that the second intersection condition is not established, when the CPU in step 746 determines that the length condition is not established, or when the CPU in step 750 determines that the time period condition is not established, the CPU also determines that the object does not approach from the left side or the right side of the host vehicle 100 (in other words, the CPU determines that the object is very unlikely to cross the second left-side expected path and/or the second right-side expected path having a line segment shape within the threshold time period), makes a "No" determination in any of step 740, step 746, and step 750, and performs a process of step 754 below.

Step 754: The CPU sets the value of the attention calling flag to 0 for the handled object (that is, the object selected in step 730) and stores the set value in the RAM of the driving assistance ECU 10 in association with the object. The attention calling flag is provided for each object (each object selected in step 730). Then, the CPU transitions to step 756 below.

In step 756, the CPU determines whether or not the processes from step 730 described above are executed for all objects having the object information acquired in step 608 in FIG. 6. When the CPU determines that the processes described above are not yet executed for all objects, the CPU makes a "No" determination in step 756, returns to step 730, and repeats the processes from step 730 for the remaining objects. When the CPU determines that the processes described above are executed for all objects, the CPU makes a "Yes" determination in step 756 and transitions to step 612 in FIG. 6 through step 758.

Figure 8:
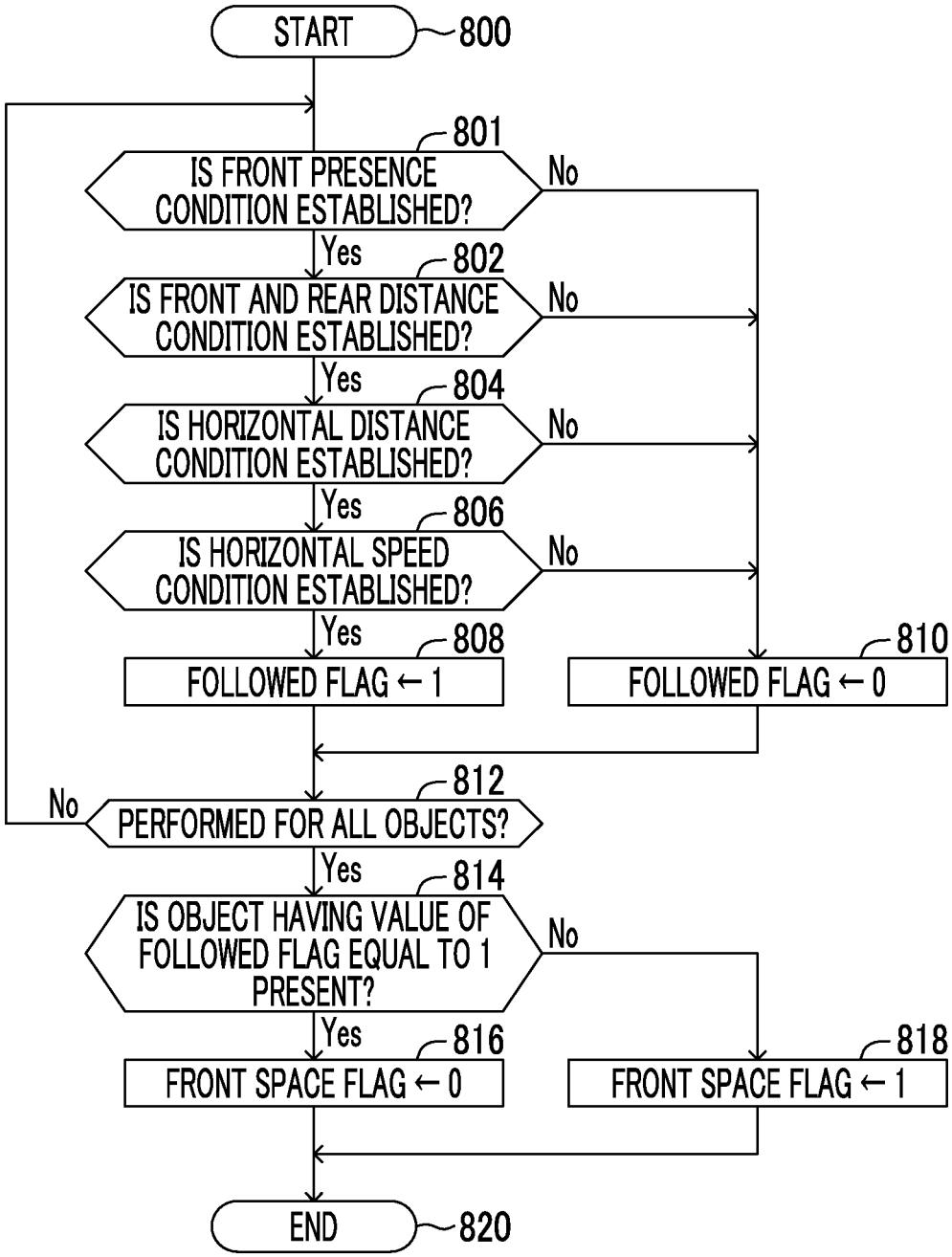
FIG. 8 is a flowchart (4) illustrating a routine executed by the CPU of the present embodied apparatus.

When the CPU transitions to step 612, the CPU executes the front space determination by executing the routine illustrated in the flowchart in FIG. 8. That is, when the CPU transitions to step 612, the CPU starts from a process of step 800 in FIG. 8 and transitions to step 801 below.

In step 801, the CPU selects any one object from the objects having the object information acquired in step 608 in FIG. 6 and determines whether or not the front presence condition (the value of the x coordinate of the relative position P(n) of the object satisfies $0 \leq x$) is established based on the object information of the selected object. When the CPU determines that the front presence condition is established, the CPU makes a "Yes" determination in step 801 and transitions to step 802 below. The CPU performs appropriate processes from step 801 to step 810 described below for each selected object (refer to step 812 described below).

In step 802, for the object for which the CPU in step 801 determines that the front presence condition is established, the CPU determines whether or not the front and rear distance condition (the value of the x coordinate of the relative position P(n) of the object satisfies $0 \leq x \leq 6$) is established based on the object information of the object. When the CPU determines that the front and rear distance condition is established, the CPU makes a "Yes" determination in step 802 and transitions to step 804 below.

In step 804, for the object for which the CPU in step 802 determines that the front and rear distance condition is established, the CPU determines whether or not the horizontal distance condition (the absolute value of the y coordinate of the relative position P(n) of the object is less than or equal to two) is established based on the object information of the object. When the CPU determines that the horizontal distance condition is established, the CPU makes a "Yes" determination in step 804 and transitions to step 806 below.

In step 806, for the object for which the CPU in step 804 determines that the horizontal distance condition is established, the CPU determines whether or not the horizontal speed condition ($SPDoy(n) \leq 5$ km/h) is established based on the object information of the object. When the CPU determines that the horizontal speed condition is established, the CPU makes a "Yes" determination in step 806 and performs a process of step 808 below.

Step 808: The CPU sets the value of the followed flag to 1 for the object (approximately parallel object) for which the CPU in step 806 determines that the horizontal speed condition is established, and stores the set value in the RAM of the driving assistance ECU 10 in association with the object. Then, the CPU transitions to step 812 described below.

When the CPU in step 801 determines that the front presence condition is not established, when the CPU in step 802 determines that the front and rear distance condition is not established, when the CPU in step 804 determines that the horizontal distance condition is not established, or when the CPU in step 806 determines that the horizontal speed condition is not established, the CPU determines that the object is not the followed object, makes a "No" determination in any of step 801, step 802, step 804, and step 806, and performs a process of step 810 below.

Step 810: The CPU sets the value of the followed flag to 0 for the object and stores the set value in the RAM of the driving assistance ECU 10 in association with the object. The followed flag is provided for each object (each object selected in step 801). Then, the CPU transitions to step 812 below.

In step 812, the CPU determines whether or not the processes from step 801 described above are executed for all objects having the object information acquired in step 608 in FIG. 6. When the CPU determines that the processes described above are not yet executed for all objects, the CPU makes a "No" determination in step 812, returns to step 801, and repeats the processes from step 801 for the remaining objects. When the CPU determines that the processes described above are executed for all objects, the CPU makes a "Yes" determination in step 812 and transitions to step 814 below.

In step 814, the CPU determines whether or not an object having the value of the followed flag equal to 1 is present among the objects (that is, whether or not the followed object is present within the front region). When the object having the value of the followed flag equal to 1 is present, the CPU makes a "Yes" determination in step 814 (that is, determines that there is no front space) and performs a process of step 816 below.

Step 816: The CPU sets the value of the front space flag to 0 and stores the set value in the RAM of the driving assistance ECU 10. Then, the CPU transitions to step 614 in FIG. 6 (described below) through step 820.

When the object having the value of the followed flag equal to 1 is not present, the CPU makes a "No" determination in step 814 (that is, determines that there is the front space) and performs a process of step 818 below.

Step 818: The CPU sets the value of the front space flag to 1 and stores the set value in the RAM of the driving assistance ECU 10. Then, the CPU transitions to step 614 in FIG. 6 through step 820.

In step 614, the CPU selects any one object from the objects having the object information acquired in step 608 and determines whether or not the value of the attention calling flag for the selected object is 0. When the value of the attention calling flag is 0, the CPU makes a "Yes" determination in step 614 (that is, determines that the object is not the target object) regardless of the value of the front space flag and performs a process of step 616 below. The CPU performs the processes from step 614 to step 622 for each selected object (refer to step 624 described below).

Step 616: The CPU does not generate the request signal for the object selected in step 614 (hereinafter, referred to as a "selected object"). Thus, attention is not called to the selected object by the display device 21. Then, the CPU transitions to step 624 described below.

When the value of the attention calling flag for the selected object is 1, the CPU makes a "No" determination in step 614 and transitions to step 618 below.

In step 618, the CPU determines whether or not the value of the front space flag is 0. When the CPU determines that the value of the front space flag is 0 (that is, when the CPU determines that the value of the attention calling flag for the selected object is 1 and that the value of the front space flag is 0), the CPU makes a "Yes" determination in step 618 (that is, determines that since there is no front space even though the selected object is present as the target object, the target object is very unlikely to cross the left-side expected path and/or the right-side expected path of the host vehicle 100) and transitions to step 620 below.

Step 620: The CPU forbids generation of the request signal for the selected object. Thus, calling attention to the selected object by the display device 21 is forbidden. Then, the CPU transitions to step 624 described below.

When the CPU determines that the value of the front space flag is 1 (that is, when the CPU determines that the value of the attention calling flag for the selected object is 1 and that the value of the front space flag is 1), the CPU makes a "No" determination in step 618 (that is, determines that since the selected object as the target object is present and there is the front space, the target object passes through the front space and is consequently likely to cross the left-side expected path and/or the right-side expected path of the host vehicle 100) and transitions to step 622 below.

Step 622: The CPU generates the request signal for the selected object and transmits the request signal to the display ECU 20. Accordingly, attention is called to the selected object by the display device 21. Then, the CPU transitions to step 624 below.

In step 624, the CPU determines whether or not the processes from step 614 described above are executed for all objects having the object information acquired in step 608. When the CPU determines that the processes described above are not yet executed for all objects, the CPU makes a "No" determination in step 624, returns to step 614, and repeats the processes from step 614 for the remaining objects. When, for example, any process of step 616 and step 620 is performed for the object B different from the object A at the time of calling attention to the object A by the process of step 622, the state of calling attention to the object A is continued. When, for example, the process of step 622 is performed for the object B different from the object A at the time of calling attention to the object A by the process of step 622, attention is called to both of the object A and the object B. That is, a determination as to whether or not to call attention is performed for each object. When the CPU determines that the processes described above are executed for all objects, the CPU makes a "Yes" determination in step 624 and performs a process of step 626 below.

Step 626: The CPU initializes (sets to 0) the value of the attention calling flag and the value of the followed flag for each object. The CPU initializes (sets to 0) the value of the front space flag. The values of the flags are initialized by the CPU when the engine switch is changed from the OFF state to the ON state. Then, the CPU transitions to step 628 and temporarily finishes the present routine.

Effects of the present embodied apparatus will be described. The present embodied apparatus determines whether or not there is the front space. When the present embodied apparatus determines that there is no front space, the present embodied apparatus forbids attention calling even when the present embodied apparatus determines that the target object is present. When there is no front space, the target object may not pass in front of the host vehicle 100. Thus, the target object is very unlikely to cross the left-side expected path and/or the right-side expected path of the host vehicle 100 within the threshold time period. Accordingly, even when the present embodied apparatus determines that the target object is present, the present embodied apparatus can forbid attention calling when the target object is actually very unlikely to cross the left-side expected path and/or the right-side expected path of the host vehicle 100 within the threshold time period due to the absence of the front space. Thus, the present embodied apparatus can significantly reduce the possibility of attention calling that does not have to be performed, and can more appropriately call attention of the driver of the host vehicle.

Particularly, the present embodied apparatus determines whether or not the approximately parallel object (an object of which the horizontal speed SPDoy(n) is less than or equal to the horizontal speed threshold) is present within the front region. When the present embodied apparatus determines that such an object is present, the present embodied apparatus determines that there is no front space. The length of the front region in the x-axis direction (the traveling direction TDv of the host vehicle 100) is equal to the front and rear distance threshold (6 m in the present example) and is set to be less than or equal to the length of each expected path of the host vehicle 100 (7 m in the present example). Thus, the front region is present on the expected path of the target object. Accordingly, when the approximately parallel object is present within the front region, the approximately parallel object hinders traveling of the target object. Consequently, the target object is very unlikely to cross the left-side expected path and/or the right-side expected path of the host vehicle 100 within the threshold time period. The configuration described above can determine that there is no front space, when the target object is very unlikely to cross the left-side expected path and/or the right-side expected path of the host vehicle 100 within the threshold time period. Thus, the configuration can appropriately determine whether or not there is the front space.

The center of the front region in the y-axis direction (the horizontal direction of the host vehicle 100) is positioned on the x axis (that is, on a line that passes through the center of the front end portion of the host vehicle 100 and extends in the traveling direction TDv of the host vehicle 100). The length of the front region in each of the positive direction and the negative direction of the y-axis direction is equal to the horizontal distance threshold (2 m in the present example). That is, the front region has the equal horizontal length with respect to the x axis. Thus, by setting the horizontal distance threshold to an appropriate value, the front region can be set as a region that is positioned in the forward front of the host vehicle 100. Accordingly, an object that is present in a position horizontally away from the forward front of the host vehicle 100 can be excluded (not set as a target of extraction) in the front space determination, and an object that is present in the forward front of the host vehicle 100 (that is, the followed object) can be appropriately extracted. Thus, a determination as to whether or not there is the front space can be more appropriately performed.

While the driving assistance apparatus according to the embodiment of the present disclosure is described heretofore, an applicable embodiment of the present disclosure is not limited thereto. Various modifications can be made to the extent not departing from the gist of the present disclosure.

For example, the order of determinations as to whether or not the front and rear distance condition, the horizontal distance condition, and the horizontal speed condition are established is not limited to the configuration described above and is not fixed.

A same direction condition described below may be added to the front presence condition, the front and rear distance condition, the horizontal distance condition, and the horizontal speed condition described above. That is, the same direction condition is a condition that "an angle θip(n) between the traveling direction TDv(n) of the host vehicle 100 and the traveling direction TDo(n) of the object is less than or equal to a predetermined angle threshold (for example, 20°)". When the same direction condition is established for an object, the driving assistance ECU 10 determines that the traveling direction TDo(n) of the object is approximately the same as the traveling direction TDv(n) of the host vehicle 100. By adding the same direction condition to each condition described above, a determination as to whether or not an "object that is present within the front region and has the traveling direction TDo(n) which is "approximately the same" as the host vehicle 100" is present can be performed in the front space determination. Thus, a determination as to whether or not the object is an object followed by the host vehicle 100 can be more accurately performed. The angle θip(n) can be calculated by using the inner product of a unit vector in the traveling direction TDv(n) of the host vehicle 100 and a unit vector in the traveling direction TDo(n) of the object.

The driving assistance apparatus may include an alert ECU and a buzzer instead of the display ECU 20 and the display device 21. Specifically, the alert ECU is connected to the driving assistance ECU 10 through the communication and sensor system CAN 90 in a manner capable of exchanging data. The buzzer is connected to the alert ECU. When the alert ECU receives the attention calling request signal from the driving assistance ECU 10, the alert ECU transmits an instruction signal to the buzzer. When the buzzer receives the instruction signal from the alert ECU, the buzzer emits an alert so as to call attention of the driver. The configuration described above can also achieve the same effects as the embodied apparatus.

The present embodied apparatus performs the target object determination and the front space determination based on the object information that is acquired based on the signals output from the three radar sensors 15 respectively disposed at the left end, the center, and the right end of the front end portion of the host vehicle 100. That is, the target object determination and the front space determination are performed based on the same object information. However, the object information used when the target object determination and the front space determination are performed does not have to be the same. That is, the target object determination may be performed based on the object information that is acquired based on the signals output from two radar sensors 15 respectively disposed at the left end and the right end of the front end portion of the host vehicle 100. The front space determination may be performed based on the object information that is acquired based on the signal output from one radar sensor 15 disposed at the center of the front end portion of the host vehicle 100. An object that may be the target object is comparatively likely to be present in the left front and the right front of the host vehicle 100. The approximately parallel object that is present within the front region and is a reference for determining whether or not there is the front space is comparatively likely to be present in the forward front of the host vehicle 100. Thus, the configuration described above can also appropriately acquire the object information for each determination. The positions and the number of radar sensors 15 disposed are not limited thereto.

The driving assistance apparatus may be configured to estimate one or three or more expected paths instead of estimating two expected paths of the left-side expected path and the right-side expected path. The expected path is not limited to paths through which the left end OL and the right end OR of the host vehicle 100 are expected to pass (that is, the left-side expected path and the right-side expected path). For example, the expected path may be a path through which the position O of the host vehicle 100 is expected to pass. Alternatively, the left-side expected path may be a path through which a point that is separated leftward by a first predetermined distance from the left end OL of the host vehicle 100 is expected to pass. The right-side expected path may be a path through which a point that is separated rightward by a second predetermined distance from the right end OR of the host vehicle 100 is expected to pass.

The driving assistance apparatus may acquire the object information by using a camera or a roadside device instead of the radar sensors 15 or in addition to the radar sensors 15.

The driving assistance apparatus may be mounted not only in a vehicle traveling on a left-hand traffic road but also in a vehicle traveling on a right-hand traffic road.

The driving assistance apparatus may use a value estimated from a horizontal acceleration and the vehicle speed SPDv as the yaw rate Y or use a value estimated from a steering angle and the vehicle speed SPDv as the yaw rate Y instead of using the value detected by the yaw rate sensor 13 as the yaw rate Y.

What is claimed is:

1. A driving assistance apparatus comprising:

a plurality of sensor devices mounted in a host vehicle;

an attention calling device configured to call attention of a driver of the host vehicle; and at least one electronic control unit configured to acquire, based on detection outputs of the sensor devices, host vehicle information including parameters related to a vehicle speed of the host vehicle and a yaw rate of the host vehicle, acquire, based on the detection outputs of the sensor devices, object information including a relative position of an object present around the host vehicle with respect to the host vehicle, a traveling direction of the object, and a speed of the object, estimate, based on the host vehicle information, an expected path through which the host vehicle is expected to pass, determine, based on the object information, whether or not a target object that is an object likely to cross the expected path within a threshold time period is present, determine, based on at least the object information, whether or not there is a front space in front of the host vehicle, front space being a space allowing the target object to pass in front of the host vehicle, generate a request signal so as to call attention of the driver of the host vehicle, when the electronic control unit determines that the target object is present, and that there is the front space, forbid generation of the request signal when the electronic control unit determines that the target object is present, and that there is no front space, and control the attention calling device to call attention of the driver in response to generation of the request signal.

2. The driving assistance apparatus according to claim 1, wherein:

the electronic control unit is configured to extract an object that is present around the host vehicle;

the electronic control unit determines whether or not all of a predetermined front and rear distance condition, a predetermined horizontal distance condition, and a predetermined horizontal speed condition are satisfied, the front and rear distance condition being a condition that a front and rear distance that is a distance from the host vehicle to the extracted object in a traveling direction of the host vehicle is less than or equal to a predetermined front and rear distance threshold, the horizontal distance condition being a condition that a horizontal distance is less than or equal to a predetermined horizontal distance threshold, the horizontal distance being a distance from the host vehicle to the extracted object in an orthogonal direction that is a direction orthogonal with respect to the traveling direction of the host vehicle, and the horizontal speed condition being a condition that a horizontal speed that is a speed of the extracted object in the orthogonal direction is less than or equal to a predetermined horizontal speed threshold; and the electronic control unit is configured to determine that there is no front space, when the electronic control unit determines that the extracted object satisfies all of the conditions.

3. The driving assistance apparatus according to claim 2, wherein:

the electronic control unit is configured to determine whether or not the host vehicle is traveling straight;

when the electronic control unit determines that the host vehicle is traveling straight, the electronic control unit estimates, as the expected path, a path that extends in a linear shape in the traveling direction of the host vehicle from the host vehicle and has a predetermined length; and the electronic control unit is configured to set the front and rear distance threshold to be less than or equal to the predetermined length of the expected path of the host vehicle.

* * * * *